US007175265B2

(12) United States Patent
Tsuyama et al.

(10) Patent No.: US 7,175,265 B2
(45) Date of Patent: Feb. 13, 2007

(54) HOLDING APPARATUS TO HOLD FLEXIBLE BELTLIKE MEMBER FORMING INK CHANNEL, AND RECORDING APPARATUS

(75) Inventors: Kazuhiko Tsuyama, Nagano-ken (JP); Takayuki Shiota, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 253 days.

(21) Appl. No.: 10/930,605

(22) Filed: Aug. 30, 2004

(65) Prior Publication Data

US 2005/0083383 A1 Apr. 21, 2005

(30) Foreign Application Priority Data

| | | |
|---|---|---|
| Aug. 28, 2003 | (JP) | 2003-304661 |
| Aug. 28, 2003 | (JP) | 2003-304763 |
| May 18, 2004 | (JP) | 2004-147580 |
| Jul. 7, 2004 | (JP) | 2004-200054 |

(51) Int. Cl.
*B41J 2/175* (2006.01)
*B41J 23/00* (2006.01)

(52) U.S. Cl. ..... 347/85; 347/37; 347/86

(58) Field of Classification Search ..... 347/49, 347/66, 85, 37; 400/283, 315, 320
See application file for complete search history.

(56) References Cited

U.S. PATENT DOCUMENTS 6,068,370 A * 5/2000 Miller et al. ..... 347/85
6,789,882 B2 * 9/2004 Hiramatsu et al. ..... 347/84

FOREIGN PATENT DOCUMENTS

| | | |
|---|---|---|
| JP | H10-226084 | 8/1998 |
| JP | 2002-067279 | 3/2002 |

* cited by examiner

*Primary Examiner*—Lamson Nguyen
*Assistant Examiner*—Lisa M. Solomon
(74) *Attorney, Agent, or Firm*—John J. Penny, Jr.; Edwards Angell Palmer & Dodge LLP

(57) ABSTRACT

A flexible beltlike member in which a plurality of ink channels are formed interconnects a carriage and an ink cartridge. A first turn unit is formed in the flexible beltlike member, wherein the turn unit is in U shape seen from top. A carriage side holding apparatus for holding the beltlike member in the carriage includes a holder unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the ink cartridge is perpendicular to a side extending to the carriage.

14 Claims, 27 Drawing Sheets

HOLDING APPARATUS TO HOLD FLEXIBLE BELTLIKE MEMBER FORMING INK CHANNEL, AND RECORDING APPARATUS

This patent application claims priority from Japanese patent applications Nos. 2003-304763 filed on Aug. 28, 2003, 2003-304661 filed on Aug. 28, 2003, 2004-147580 filed on May 18, 2004, 2004-200054 filed on Jul. 7, 2004, the contents of which are incorporated herein by reference.

BACKGROUND OF THE INVENTION

1. Field of the Invention

The present invention relates to a holding apparatus for a flexible beltlike member which holds the flexible beltlike member in the carriage, and a recording apparatus including the holding apparatus in the recording apparatus including: an ink-jet recording head provided in a carriage reciprocating in main scanning direction; an ink cartridge provided independently of the carriage; and a flexible beltlike member in which the ink channel interconnecting the ink-jet recording head and the ink cartridge is provided. In addition, the present invention relates to a liquid ejecting apparatus.

Here, the liquid ejecting apparatus means a printer, a copying machine or a facsimile which performs recording by injecting ink from the recording head onto the recording medium using an ink-jet type recording head, as well as any apparatus which makes the liquid to be adhered onto an exposed media corresponding to the recording medium by injecting any type of liquid suitable for a predetermined purpose instead of the ink from a liquid injection head corresponding to the ink-jet type recording head.

Other than the above-mentioned recording head, the liquid injection head includes a coloring-material injection head used for color filter manufacturing such as a liquid crystal display, an electrode material (conductive paste) injection head used for electrode formation of an organic EL display, a field emission display (FED), etc., and an organic substance injection head used for biochip manufacture, a specimen injection head as a precision pipette, and the like.

2. Description of the Related Art

As an exemplary recording apparatus or a liquid ejecting apparatus, an ink-jet printer is known in which an ink-jet recording head is provided on a carriage that reciprocates in a main scanning direction. The carriage is caused to reciprocate in the main scanning direction, while being guided by a guide means or a guide shaft extending along the main scanning direction.

Here, there are two types of the carriage, that is, a carriage with which an ink cartridge is mounted, and a carriage which does not carry an ink cartridge. As for the ink jet printer where the ink cartridge is mounted in the carriage, the carriage reciprocates along the main scanning direction while the ink cartridge is being mounted on the carriage, and the ink is supplied from the ink cartridge to the ink-jet recording head. As for the ink jet printer which does not carry an ink cartridge in the carriage, the ink cartridge is provided in a body (substrate) of the ink jet printer independently of the carriage, and the ink cartridge and the ink-jet recording head are interconnected by an ink supply tube. Therefore, the flexible (elastic) ink supply tube is employed so that the ink supply tube may be deformable in response to the movement of the carriage as disclosed, for example, in Japanese Patent Laid-Open No. 2002-67279 and Japanese Patent Laid-Open No. H10-226084.

Apart from that, it is also possible to employ a configuration in which a plurality of ink channels are provided in the flexible beltlike member instead of a configuration in which a plurality of ink supply tubes are bundled. However, since a flexible beltlike member has flexibility only in one direction (surface direction) in such a configuration, guidance of the flexible beltlike member extending from the carriage is likely to be difficult.

In particular, when the flexible beltlike member extends from the carriage in which the surface is brought to be a horizontal position, the position needs to be changed so that the surface is vertically oriented. Accordingly, the structure for holding the beltlike member becomes complicated which causes an increase in cost.

In addition, as well as the carriage, when the ink cartridge is configured to be movable in the apparatus, the ink supply tube must follow the movement of the carriage and also the movement of the ink cartridge. In this case, a large space is required for guiding the flexible beltlike member in the apparatus, which makes the apparatus bulky and the holding structure complex, which also causes the increase in cost.

SUMMARY OF THE INVENTION

An object of the present invention is to simplify the construction of the guidance of a flexible beltlike member and the holding structure in a configuration where a plurality of ink channels interconnecting an ink-jet recording head and an ink cartridge is made of the flexible beltlike member so that the cost may be reduced and the flexible beltlike member may be guided in a confined space.

To solve the above problems, according to a first aspect of the present invention, there is provided a flexible beltlike member holding apparatus operable to hold a flexible beltlike member in a carriage of a recording apparatus, the recording apparatus including: an ink-jet recording head provided in the carriage reciprocating along a main scanning direction; an ink cartridge provided independently of the carriage; and a flexible beltlike member in which an ink channel, which interconnects the ink-jet recording head and the ink cartridge, is provided, where a turn unit is formed in the flexible beltlike member, wherein the turn unit is in U shape seen from top, and the flexible beltlike member holding apparatus includes a position change unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the ink cartridge is perpendicular to a side extending to the carriage.

According to a second aspect of the present invention, in the first aspect, the position change unit includes: a holder unit operable to accommodate the bend of the flexible beltlike member and to limit a direction extending toward the ink cartridge; and a cover operable to cover an opening of the holder unit, wherein the cover has a convex for maintaining the bent construction of the flexible beltlike member.

According to a third aspect of the present invention, in the second aspect, the holder unit is attached to the cover by snap fitting.

According to a fourth aspect of the present invention, in the first aspect, a pawl unit is integrally provided in the flexible beltlike member in a direction perpendicular to a longitudinal direction of the flexible beltlike member, and the flexible beltlike member is held substantially horizontally by the pawl unit fitting into an engagement hole formed in a horizontal holding unit for holding the flexible beltlike member substantially horizontally.

According to a fifth aspect of the present invention, in the fourth aspect, a flexible flat cable interconnecting a control section and the ink-jet recording head of the recording apparatus is sandwiched between the flexible beltlike member and the horizontal holding unit.

According to a sixth aspect of the present invention, in the first aspect, the number of bend(s) and curvature direction of each bend formed are consistent irrespective of movement of the carriage, wherein the bend(s) is formed in a space where the direction of the flexible beltlike member is changed to the vertical direction by the position change unit.

According to a seventh aspect of the present invention, there is provided a recording apparatus including: an ink-jet recording head provided in a carriage reciprocating along a main scanning direction; an ink cartridge provided independently of the carriage; a flexible beltlike member in which an ink channel, which interconnects the ink-jet recording head and the ink cartridge, is provided; and a flexible beltlike member holding apparatus operable to hold the flexible beltlike member in a carriage of a recording apparatus, where a turn unit is formed in the flexible beltlike member, wherein the turn unit is in U shape seen from top, and the flexible beltlike member holding apparatus includes a position change unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the ink cartridge is perpendicular to a side extending to the carriage.

According to an eighth aspect of the present invention, in the seventh aspect, the recording apparatus further including a body side holding apparatus operable to hold the flexible beltlike member and a flexible flat cable extending from the position change unit at a body side of the recording apparatus, wherein the direction of each of the flexible beltlike member and the flexible flat cable is changed to a vertical position by the position change unit, and the flexible beltlike member and the flexible flat cable are guided so that each of them is substantially in a U-shape, and have a clearance between the flexible beltlike member and the flexible flat cable in a direction perpendicular to a moving direction of the carriage.

According to a ninth aspect of the present invention, there is provided a liquid ejecting apparatus including: a liquid injection head provided in a carriage reciprocating along a main scanning direction; a liquid cartridge provided independently of the carriage; a flexible beltlike member in which the liquid channel for interconnecting the liquid injection head and the liquid cartridge is formed; and a flexible beltlike member holding apparatus operable to hold the flexible beltlike member in the carriage, where a turn unit is formed in the flexible beltlike member, wherein the turn unit is in U shape seen from top, and the flexible beltlike member holding apparatus includes a position change unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the liquid cartridge is perpendicular to a side extending to the carriage.

According to a tenth aspect of the present invention, there is provided a flexible beltlike member holding apparatus operable to hold a flexible beltlike member at a body side of a recording apparatus, wherein the recording apparatus includes: an ink-jet recording head provided in a carriage reciprocating along a main scanning direction; an ink cartridge provided independently of the carriage; and a flexible beltlike member in which an ink channel, which interconnects the ink-jet recording head and the ink cartridge, is provided, where a turn unit is formed in the flexible beltlike member so that an ink channel extending to the ink cartridge is substantially parallel with an ink channel extending to the carriage, wherein the turn unit is in U shape seen from top, the flexible beltlike member holding apparatus includes an accommodation unit operable to accommodate a bend formed by bending the turn unit at center of the U-shaped construction so that the parallelity between the ink channel extending to the ink cartridge and the an ink channel extending to the carriage may be maintained, and the flexible beltlike member holding apparatus holds the bend in the accommodation unit using self-reset characteristic of the bend in the accommodation unit.

According to an eleventh aspect of the present invention, in the tenth aspect, a pawl unit is formed in the accommodation unit, and the bend is locked by the pawl unit in the accommodation unit.

According to a twelfth aspect of the present invention, in the tenth aspect, the ink cartridge is provided so that it may slide along a direction perpendicular to the main scanning direction, the flexible beltlike member extending to the ink cartridge from the accommodation unit extends toward a rear side of the recording apparatus of which the flat surface is maintained to be substantially horizontal, it curves and turns over, and then extends along the ink cartridge, and the flexible beltlike member extending to the carriage from the accommodation unit extends along the main scanning direction of which the flat surface is maintained to be substantially vertical.

According to a thirteenth aspect of the present invention, there is provided a recording apparatus including: an ink-jet recording head provided in a carriage reciprocating along a main scanning direction; an ink cartridge provided independently of the carriage; a flexible beltlike member in which an ink channel, which interconnects the ink-jet recording head and the ink cartridge, is provided; and a flexible beltlike member holding apparatus operable to hold a flexible beltlike member at a body side of the recording apparatus, where a turn unit is formed in the flexible beltlike member so that an ink channel extending to the ink cartridge is substantially parallel with an ink channel extending to the carriage, wherein the turn unit is in U shape seen from top, the flexible beltlike member holding apparatus includes an accommodation unit operable to accommodate a bend formed by bending the turn unit at center of the U-shaped construction so that the parallelity between the ink channel extending to the ink cartridge and the ink channel extending to the carriage may be maintained, and the recording apparatus is configured to hold the bend in the accommodation unit using self-reset characteristic of the bend in the accommodation unit.

According to a fourteenth aspect of the present invention, there is provided a liquid ejecting apparatus including: a liquid injection head provided in a carriage reciprocating along a main scanning direction; a liquid cartridge provided independently of the carriage; a flexible beltlike member in which the liquid channel for interconnecting the liquid injection head and the liquid cartridge is formed; and a flexible beltlike member holding apparatus operable to hold the flexible beltlike member at a body side of the recording apparatus, wherein a turn unit is formed in the flexible beltlike member so that a liquid channel extending to the liquid cartridge is substantially parallel with a liquid channel extending to the carriage, wherein the turn unit is in U shape seen from top, the flexible beltlike member holding apparatus includes an accommodation unit operable to accommodate a bend formed by bending the turn unit at center of the U-shaped construction so that the parallelity between the liquid channel extending to the liquid cartridge and the liquid channel extending to the carriage may be maintained, and the flexible beltlike member holding apparatus holds the bend in the accommodation unit using self-reset characteristic of the bend in the accommodation unit.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will be described in further detail by way of example with reference to the accompanying drawings.

Figure 1:
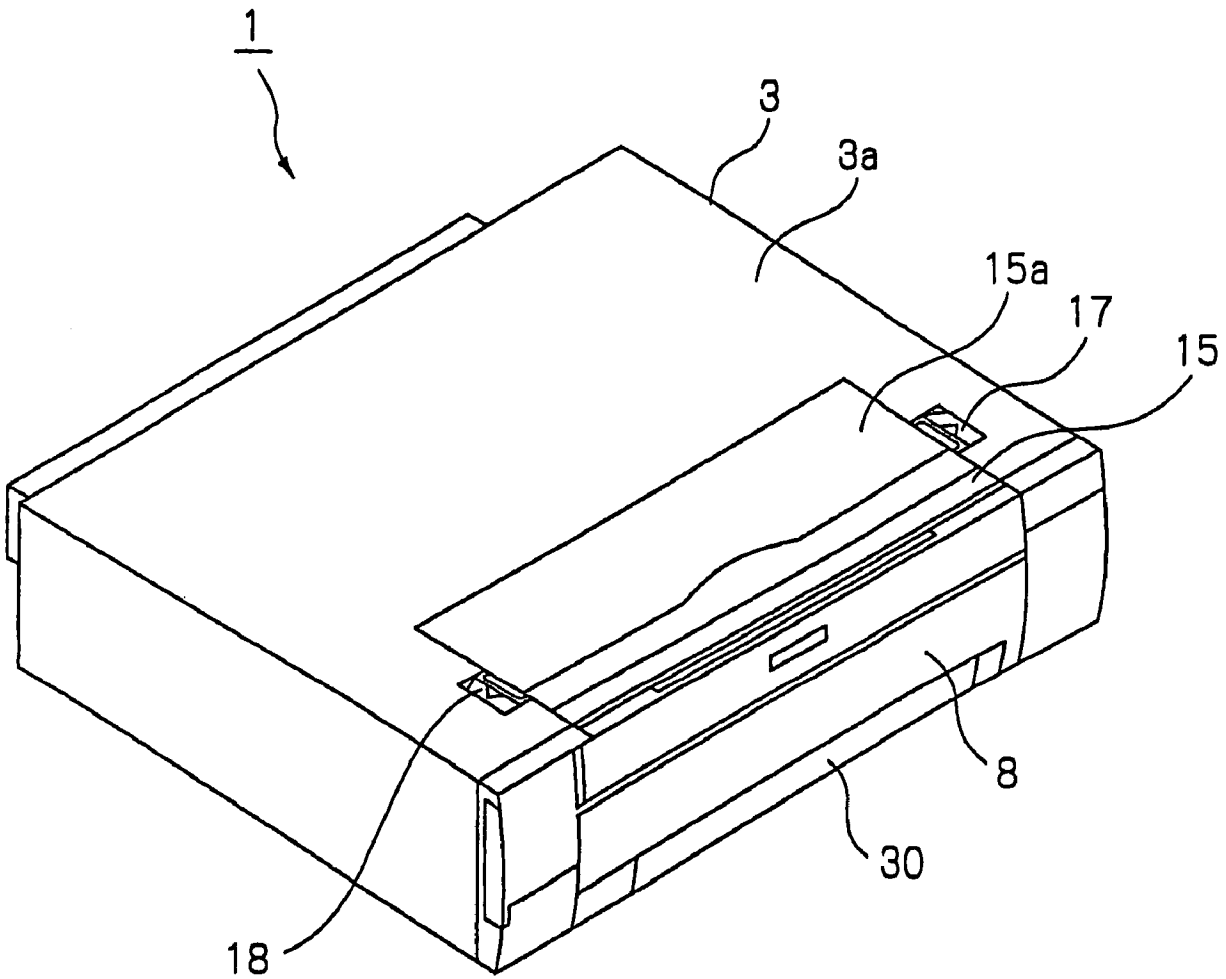
FIG. 1 is an external perspective view showing a printer according to the present invention.
Figure 2:
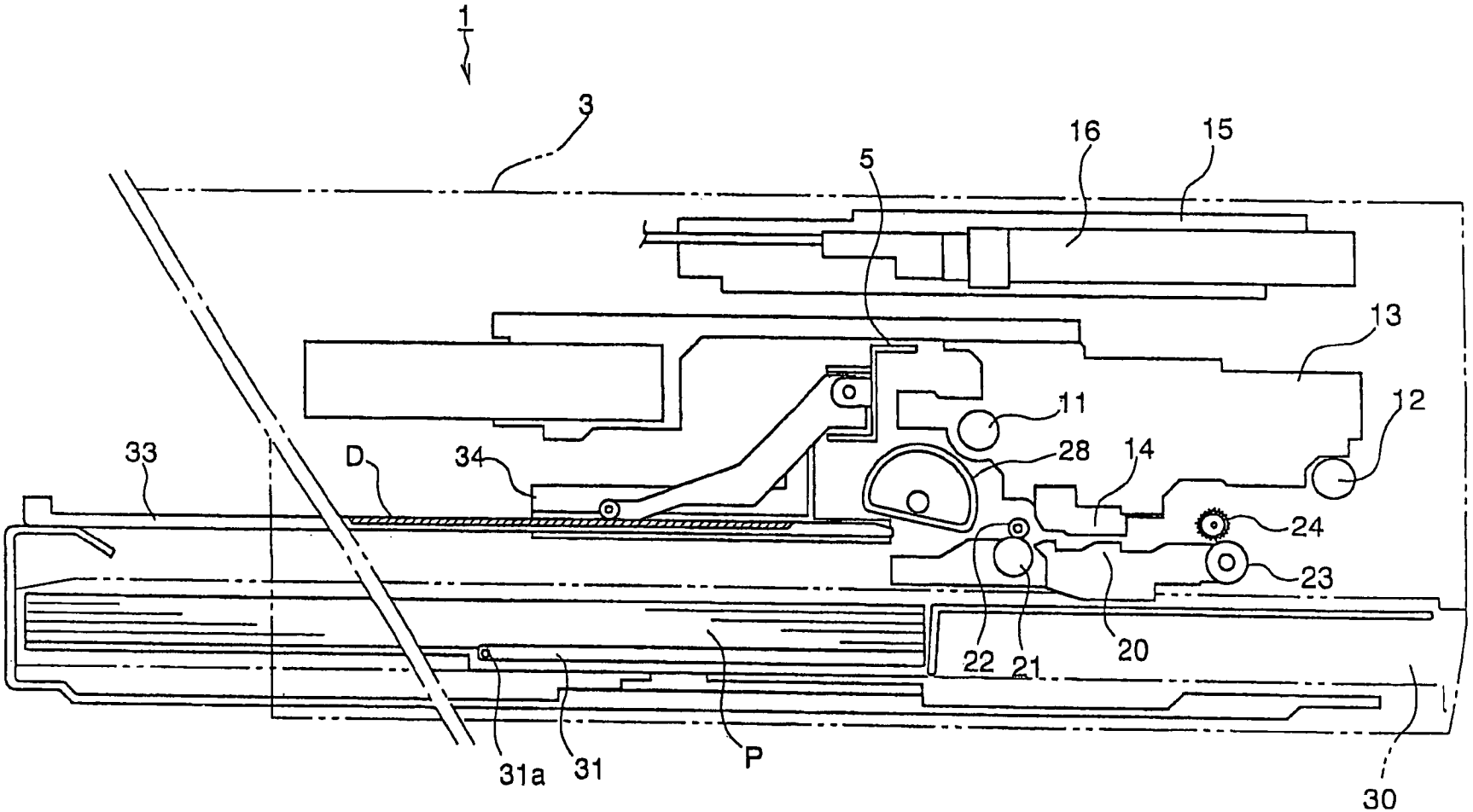
FIG. 2 is a schematic sectional side view showing the printer according to the present invention.
Figure 3:
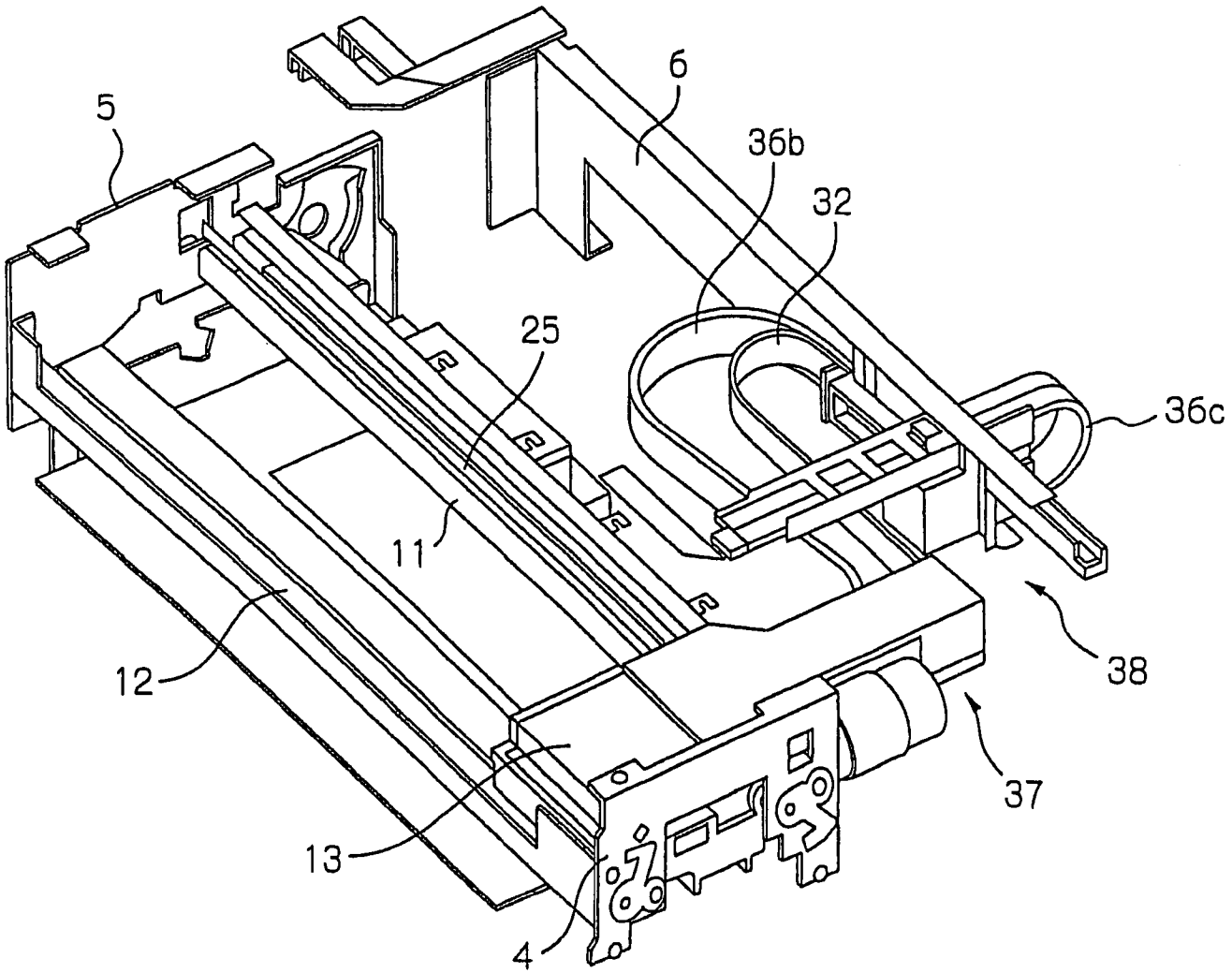
FIG. 3 is a perspective view of the body of the printer according to the present invention.
Figure 4A:
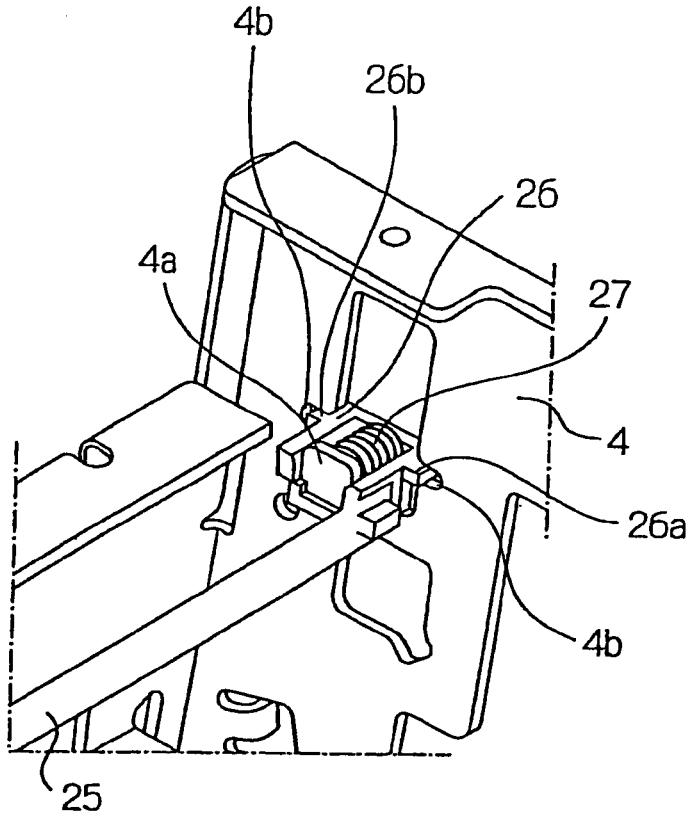
FIGS. 4A and 4B illustrate a mounting structure on a linear scale.
Figure 4B:
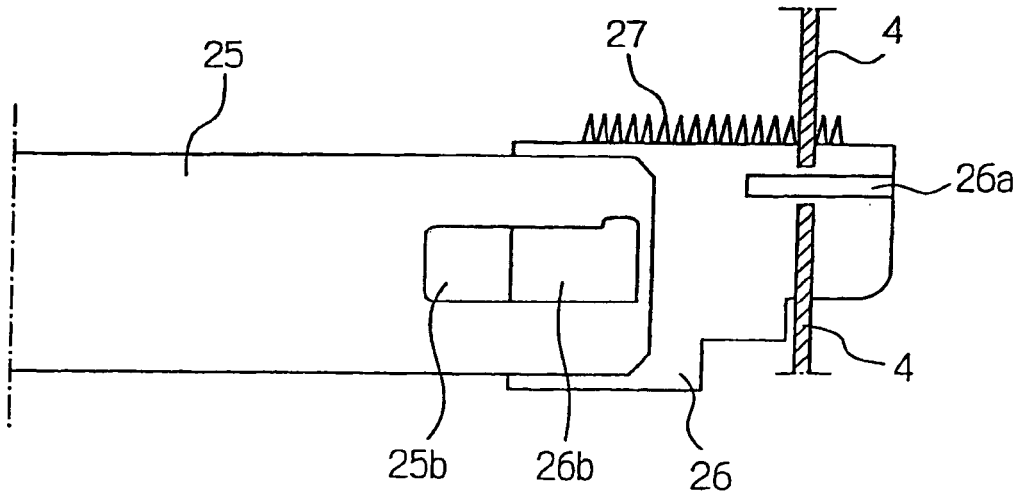
Figure 5:
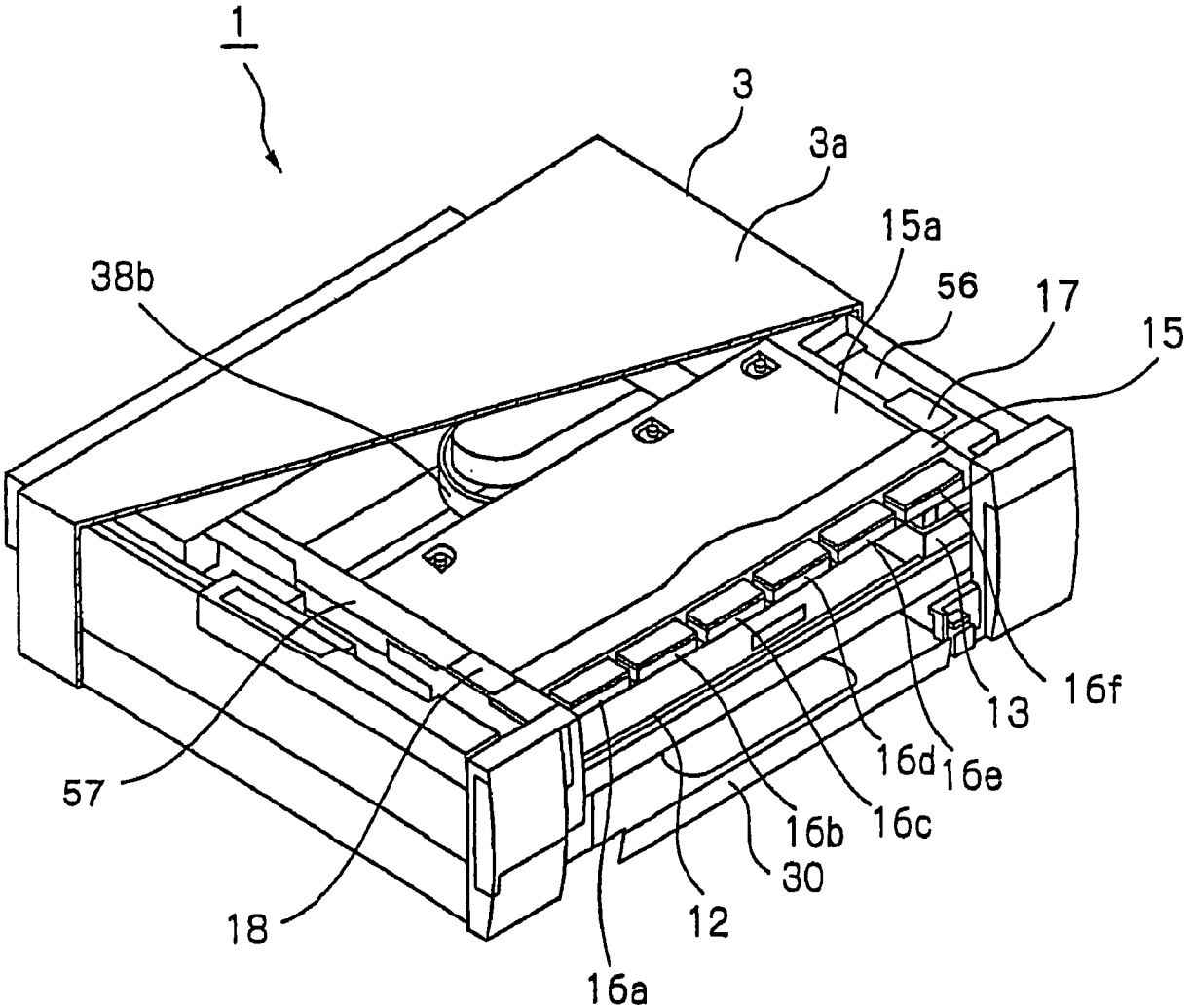
FIG. 5 is a perspective view of an ink cartridge unit.
Figure 6:
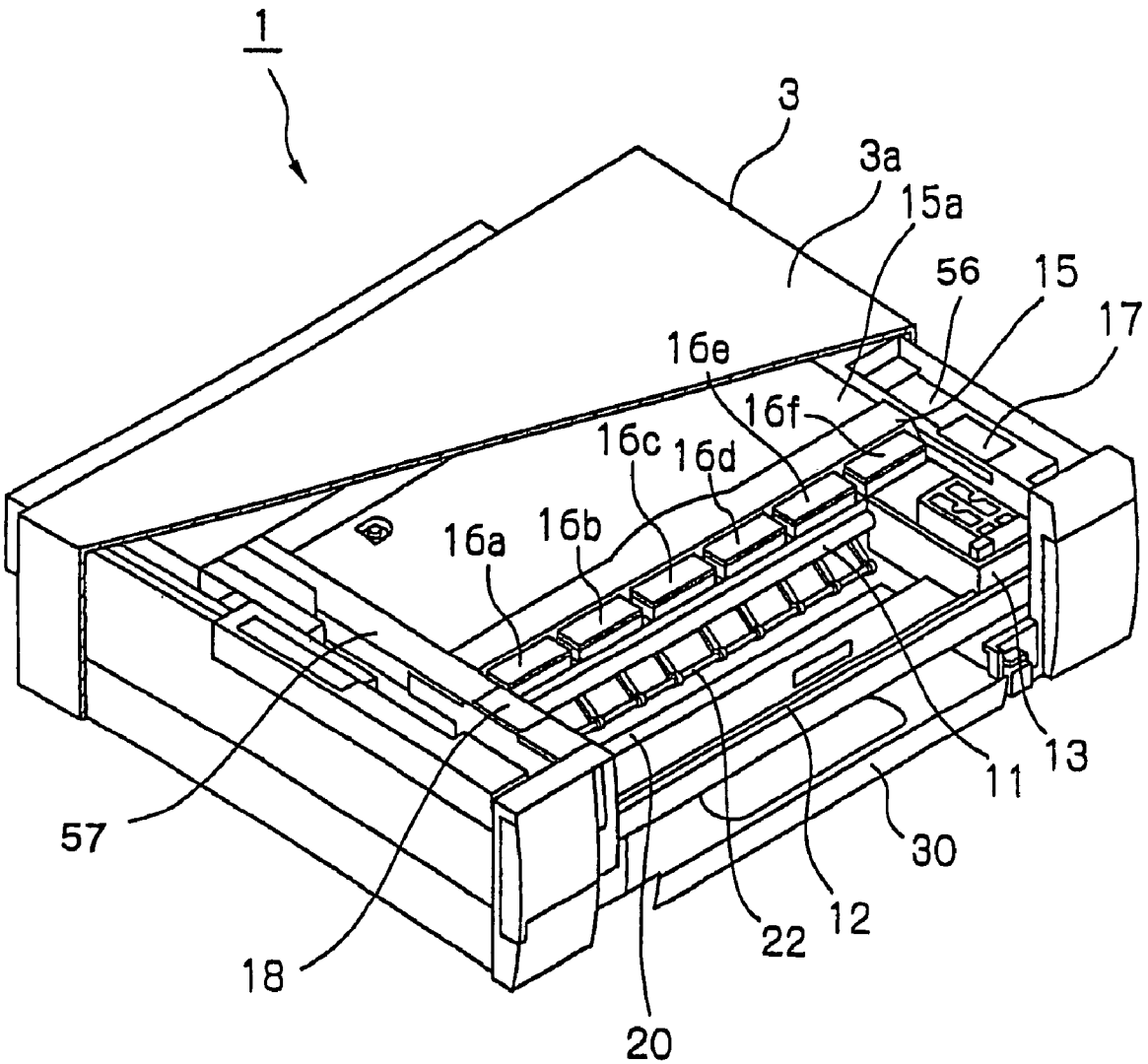
FIG. 6 is a perspective view of the ink cartridge unit.
Figure 7:
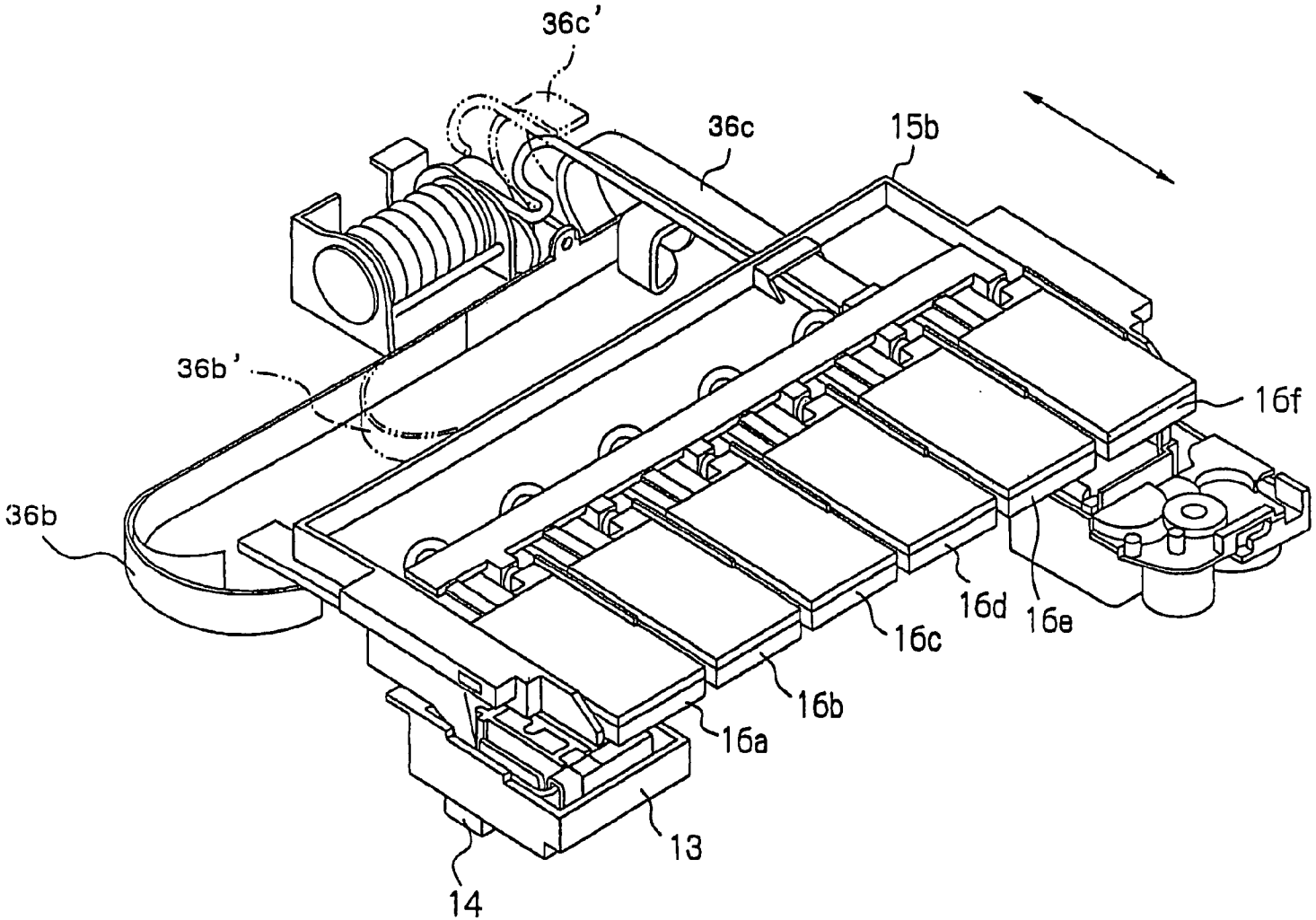
FIG. 7 is a perspective view illustrating ink channels.

First, outline of configuration of an ink jet printer (henceforth "printer") 1 as an example of a "recording apparatus" and a "liquid ejecting apparatus" according to the present invention will be described with reference to FIGS. 1–8, where FIG. 1 is an external perspective view of the printer 1, FIG. 2 is a schematic sectional side view of the printer 1, FIG. 3 is a perspective view illustrating main components of a body of the printer 1, FIGS. 4A and 4B are drawings illustrating mounting structure forming a linear encoder on a linear scale, FIGS. 5 and 6 are perspective views (a partial cutaway illustrating a housing 3) to illustrate a slide operation of the ink cartridge unit, and FIG. 7 is a perspective view illustrating ink channels extending from an ink cartridge 16 to a carriage 13.

As shown in FIG. 1, the printer 1 has the shape of a box of which the size is approximately same as a video tape recorder so that it may be housed in a television rack or the like. As can be seen in the drawing, a front cover 8 is formed in the front face of the box-shaped housing 3. The front cover is pivotally provided between an open position (operating condition, not shown) in which the cover is opened toward the user and a closed position (non-operating condition) in which the cover is closed as shown in the drawing. When it is in the open position, ejection of the recording paper, on which recording has been performed, and an attachment and detachment of the disc tray 33 (refer to FIG. 2) are allowed. A paper feed tray 30 is detachably provided in the lower part of the front cover 8, and the recording form can be set by removing it by pulling it out toward the user. An ink cartridge unit 15 (to be described later) is provided above the front cover 8, and forms the top face of the printer 1 with the housing 3. Moreover, a plurality of ink cartridges 16 (refer to FIG. 3) are detachably provided in the ink cartridge unit 15 being arranged parallel with a widthwise direction of the printer 1.

Then, outlines about the internal configuration of the printer 1 will be described with reference to FIG. 2. The printer 1 includes a detachable paper feed tray 30 at the bottom of the apparatus as mentioned above. On the paper feed tray 30, a plurality of stacked sheets of recording paper P can be set, and the hopper 31 is provided at the bottom. The hopper 31 is rockably provided on a rocker shaft 31*a*, and the bundle of the recording paper P is pushed to the feeding roller 28 by being rocked in response to a driving force provided by a driving means (not shown), that is, by pushing the set-up paper upwardly.

The feeding roller 28 seen from a side has a shape of letter "D", of which the periphery is made of high friction material (e.g., rubber material). When feeding the recording paper P, an uppermost recording paper P pressed to the circular arc part of the feeding roller 28 is fed to a downstream (rightward in FIG. 2) by revolution of the feeding roller 28. Moreover, the friction separation means (not shown), which is pressed to the circular arc part of the feeding roller 28, are provided at the lower part of the feeding roller 28, so that the uppermost recording paper P to be fed are separated from the remaining recording papers P by inserting the recording paper between the friction separation means and the feeding rollers 28.

There are provided a conveyance driving roller 21, which is driven by a conveyance motor (not shown), and a conveyance driven roller 22 which is in contact with the driving roller 21 and driven by the rotation of the driving roller 21 downstream of the feeding roller. By nipping the recording paper P with these rollers and by the conveyance driving roller 21 rotating, the recording paper P is fed under the recording head 14.

There are provided a recording head 14 and a platen 20 oppositely facing in the vertical direction, and the recording is performed when the ink drops as a "liquid" is discharged from the recording head 14 while the lower side of the fed recording paper P is being supported by the platen 20. Although the recording head 14 is provided at the bottom of the carriage 13, an ink cartridge is not mounted with the carriage 13, which reciprocates along the main scanning direction, but as mentioned above, the plurality of ink cartridges 16 are detachably provided parallel with the main scanning direction and above the main scanning area. Then, the ink is supplied to the recording head 14 in the carriage 13 through the ink channels, which will be described later in detail.

The carriage 13 is guided along the main scanning direction by a main carriage guide shaft 11 and a sub carriage guide shaft 12 which extend in the main scanning direction. The main carriage guide shaft 11 passes the rear of the carriage 13, and the sub carriage guide shaft 12 supports the front part of the carriage 13 from the bottom, thereby the distance between the recording head 14 and the recording paper P is defined. Here, it is configured so that the location in the main scanning direction of the carriage 13 is detected by a linear encoder. The linear encoder is configured by: a code disc 25 (refer to FIG. 3), of which the longitudinal axis extends along the main scanning direction; a plurality of light emitting sections (not shown) which emit light to light passing sections (not shown) provided along the main scanning direction in the code disc 25; and a light receiving section (not shown) which receives the light passing through the light passing sections. The linear encoder outputs a rising signal and a falling signal, which are generated by the light passing through the light passing sections, to detects an absolute location of the carriage 13 in the main scanning direction.

Here, the code disc 25 spans the gap between a side frame right 4 and a side frame left 5 which compose a basement of the printer 1 as shown in FIG. 3, and the tension is set up at the side of the side frame right 4 by tensioning means shown in FIGS. 4A and 4B. In FIG. 4A, a reference numeral 26 indicates a holder for holding the code disc 25, where a hook 26*b* formed in the member 26 is latched into a hole 25*b* formed in the code disc 25 as shown in FIG. 4B. The holder 26 includes a rib 26 extending along the longitudinal direction of the code disc 25 on both sides. A guide groove 4*b* which guides a rib 26 are formed on the side frame right 4, thereby the holder 26 can slide along the longitudinal direction of the code disc 25. Moreover, a spring receptacle unit 4*a* is formed in the side frame right 4, a compression spring 27 is provided between the spring receptacle unit 4*a* and the holder 26, and the compression spring presses the holder 26 outward of the side frame right 4. Therefore, the tension is given to the code disc 25 by such tensioning means.

Then, returning to FIG. 2, at the downstream of a recording head 14, there are provided an ejection driving roller 23 which is rotationally driven by a driving motor (not shown) and an ejection driven roller 24 which is in contact with the ejection driving roller 23 and driven by the rotation of the driving roller 23. The recording paper P is ejected to the printer 1 exterior by nipping the recording paper P with these rollers, and by the rotation of the ejection driving roller 23.

The disc tray 33, on which an optical disk D, e.g., DVD (Digital Versatile Disk) or the like, can be placed, is provided above the paper feed tray 30. A rack (not shown) is provided on a side of the disc tray 33. The rack moves substantially horizontally and straightly by the rotation of a pinion gear (not shown) engaging in the rack. When the recording onto the optical disk D is to be performed, the conveying means conveys the tray until an end of the tray is nipped by the conveyance driving roller 21 and the conveyance driven roller 22. Then, it is conveyed at a predetermined pitch by the driving force by the revolution of the conveyance driving roller 21 under the recording head 14, and then the recording is performed by the recording head 14.

The outline of the printer 1 has been described hereinbefore. Next, the detail of the ink channel interconnecting the carriage 13 (the recording head 14) and the ink cartridge 16 will be described hereinafter with reference to FIGS. 5–13.

First, the ink cartridge unit (to be referred to as "unit" hereinafter) 15 will be described with reference to FIGS. 5–7. Here, FIGS. 5 and 6 are perspective views of inside of the printer 1, and FIG. 7 is a perspective view of the ink channels interconnecting the unit 15 (the ink cartridges 16) and the recording head provided with the carriage 13.

As described with reference to FIG. 1, the unit 15 is provided in front of and upper side of the printer 1, and as shown in FIG. 5, it includes a plurality of ink cartridges 16*a*–16*f* along a direction parallel with the widthwise direction of the printer 1, where the colors of the ink cartridges are different from one another. The plurality of ink cartridges 16*a*–16*f* will be referred to as "ink cartridge 16" hereinafter to give a clear understanding of the specification.

The ink cartridge 16 is detachably mounted, and when it is to be replaced, it is constructed so that the lock is released and the ink cartridge 16 runs out for a predetermined distance toward a user by actuation means (not shown) by pushing it toward the back side of the printer 1. Moreover, when installing the ink cartridge 16, it is constructed so that a user pushes the ink cartridge towards the back side of the printer against the actuation force by the actuation means to lock the cartridge 16, then a liquid supply needle (not shown), which is provided for each ink cartridge, is inserted into a supply port (not shown) of each of the ink cartridges in the unit 15. In addition, instead of the push-on type attachment and detachment mechanism of the ink cartridge 16, the ink cartridge may be removed from the unit 15 by pulling it out toward the user, and may be installed by pushing it toward the back side of the printer 1.

Here, as shown in FIG. 5, since the unit 15 is provided above the main scanning area of the carriage 13 and there is a paper conveyance path for conveying the recording paper P under the carriage 13, repair works on a malfunction, e.g., clearing paper jams, is quite difficult. Accordingly, the printer 1 includes unloading means for unloading the unit 15 (the ink cartridge 16) from the upper part of the main scanning area of the carriage 13.

Knobs which bears reference numerals 17 and 18 in FIG. 5 is unit retracting knobs, and by making these unit retracting knobs 17 and 18 slide to one side of the printer 1, the locking of the unit 15 is released, and as shown by the difference from FIG. 5 to FIG. 6, the unit 15 is retracted into an retracted position, thereby a space above the main scanning area of the carriage 13 can be freed to facilitate the repair works when the malfunction occurs in the paper conveyance path.

Incidentally, since the ink cartridge 16 is not mounted with the carriage 13, the ink channels interconnecting the ink cartridge 16 and the recording head of the carriage 13 must be flexible to cope with the reciprocal movement of the carriage 13 along the main scanning direction and the slide movement between the retracted position and the non-retracted position. Therefore, as shown in FIG. 7, the ink channels are formed in the beltlike member 36 (reference numerals 36*b* and 36*c* indicates specific paths of the beltlike member 36) made of elastomer for every color, and the ink channels interconnecting the ink cartridge 16 and the carriage 13 (recording head 14) are formed. Therefore, even if the unit 15 slides to the retracted position, the beltlike member 36*c* can be deformed into a shape shown by alternate long and two short dashes lines indicated by a reference numeral 36*c*' in FIG. 7.

As mentioned above, even if some trouble occurs in the paper conveyance path, it can be solved by retracting the unit 15 to the retracted position to facilitate the trouble-shooting.

Next, the beltlike member 36 will be explained in detail with reference to FIGS. 8 and 9. Here, FIG. 8 is a sectional view of the beltlike member 36, and FIG. 9 is a top view of the beltlike member 36.

The beltlike member 36 consists of material having ink-proof characteristic, it has elasticity (flexibility), and in the present embodiment, it employs styrenic elastomer (e.g., SEPS: Styrene Ethylene Propylene Styrene Block Copolymer). However, it may be consists of any material as long as it has ink-proof characteristic and elasticity (flexibility), for example, NBR (acrylonitrile butadiene rubber), SBR (styrene-butadiene rubber), or the like.

Figure 8:
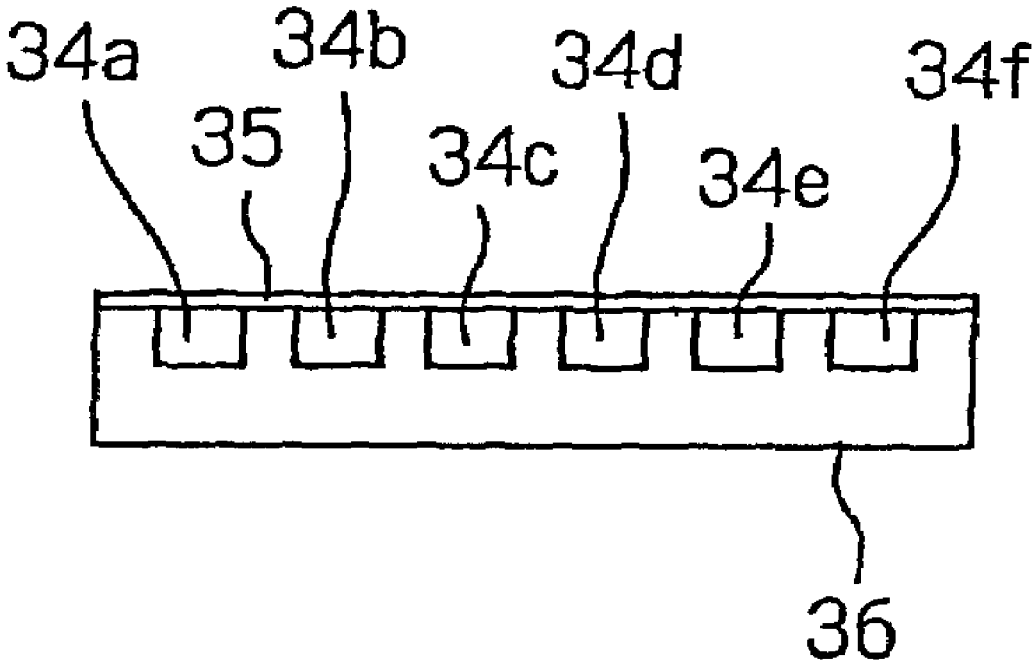
FIG. 8 is a sectional view of a beltlike member forming the ink channels.

Next, as shown in FIG. 8, a plurality of grooves 34*a*–34*f* are formed in the beltlike member 36 (broken lines shown in FIG. 9A indicate the grooves) to form the plurality of ink channels. The film 35 is attached on the surface on which the grooves are formed, thereby the ink channels are formed. Although the film 35 is made of PP (polypropylene) and heat-welded to the beltlike member 36 in the present embodiment, any material, which has ink-proof characteristic and can be attached onto the beltlike member 36, may be employed.

Figure 9A:
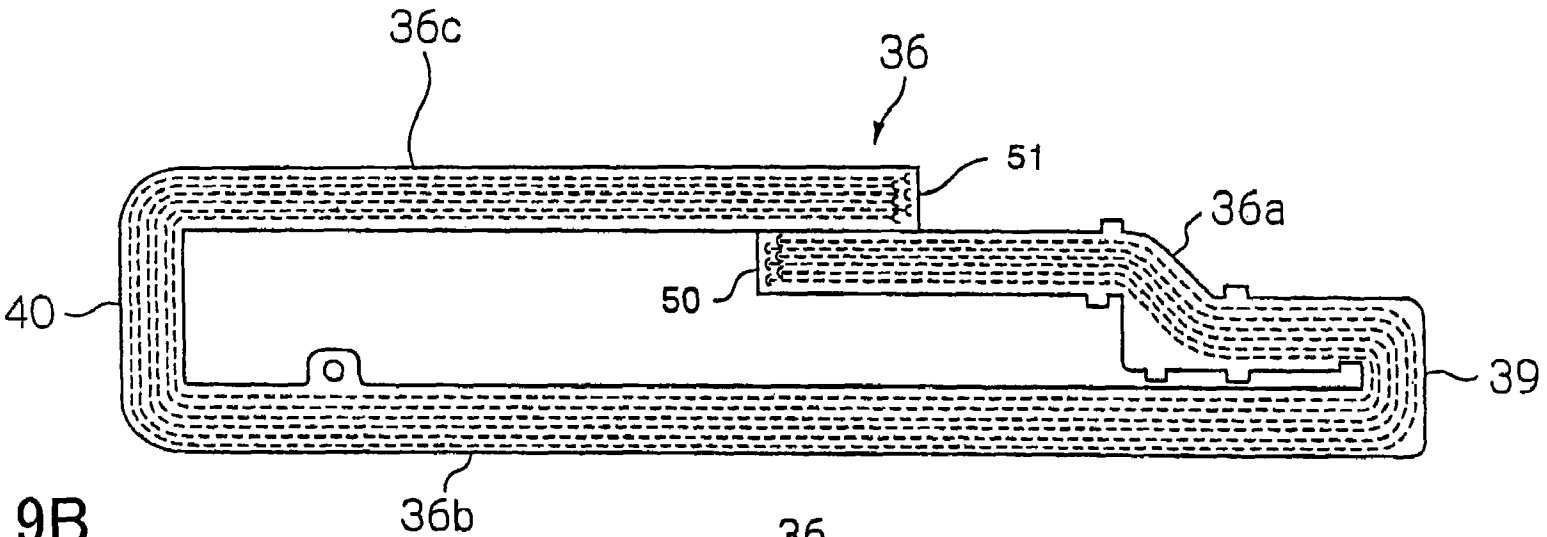
FIGS. 9A and 9B are top views of the beltlike member forming the ink channels.
Figure 9B:
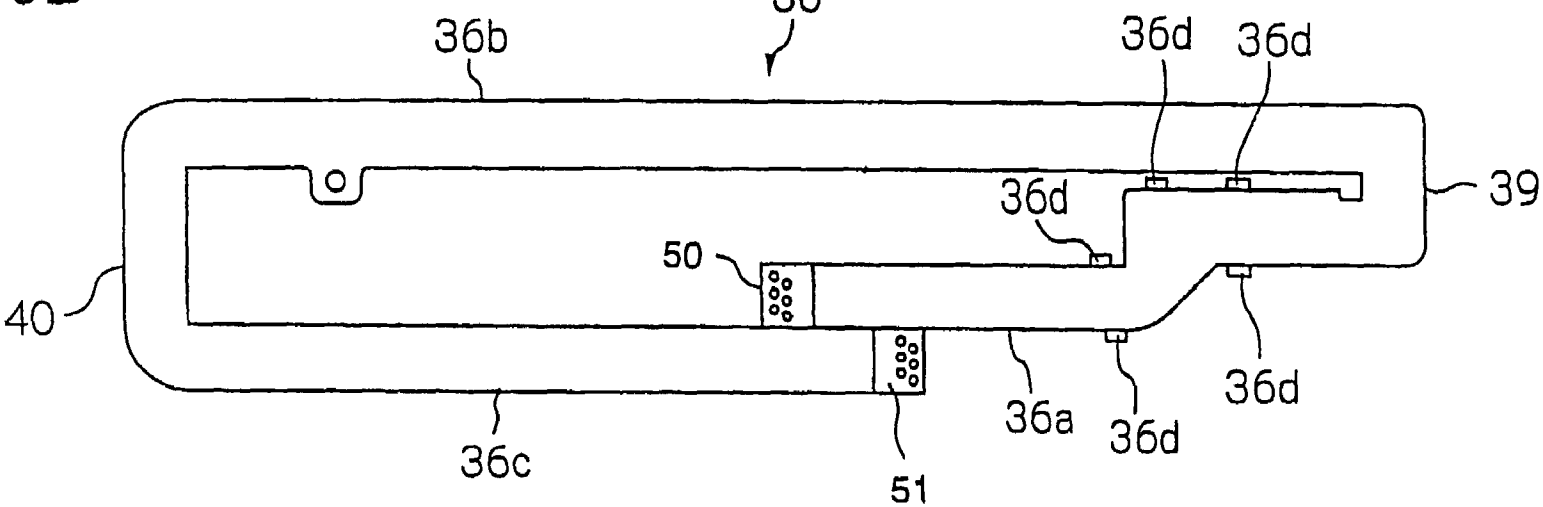

Then, the beltlike member 36 is integrally shaped into a looped structure as shown in FIG. 9. More particularly, an end 50 is connected to a side of the ink cartridge 16, an end 51 is connected to a side of the carriage 13, and the direction of the ink channels from the end 50 is turned over by a first turn unit 39 of substantially U-shape seen from the top so that a path 36*b* extending from the first turn unit 39 to the ink cartridge 16 and a path 36*a* extending to the carriage 13 may be parallel with each other. Moreover, direction of the following ink channels is turned over by a second turn unit 40 of substantially U-shape seen from the top so that a path 36*c* extending from the second turn unit 40 to the ink cartridge 16 and a path 36*b* extending from the second turn unit 40 to the carriage 13 may be parallel with each other.

The beltlike member 36 integrally formed in such a shape is guided and held as shown in FIG. 7 by two holding apparatuses shown in FIG. 3, i.e., a carriage side holding apparatus 37 and a body side holding apparatus 38. First, the carriage side holding apparatus 37 holding the beltlike member 36 in the carriage 13 (carriage 13 as a moving element moving along the main scanning direction) will be explained in detail hereinafter with reference to FIGS. 10 and 11. Here, FIG. 10 is an exploded perspective view of the carriage side holding apparatus 37, FIG. 11A is a perspective view of the carriage side holding apparatus 37, and FIG. 11B is a perspective view of the holder unit 42 as a "position change unit" which accommodates the bend of the beltlike member 36.

As shown in FIG. 3, while the carriage side holding apparatus 37 holds the beltlike member 36 which supplies ink to the recording head 14 on the carriage 13, it changes the position of the flat surface to be positioned on a vertical surface (to be referred to as "vertical position" hereinafter) so that the beltlike member 36, which extends from the carriage 13 in the position where the flat surface is positioned on a horizontal surface (to be referred to as "horizontal position" hereinafter), may be deformed in response to the movement of the carriage 13 along the main scanning direction.

Figure 10:
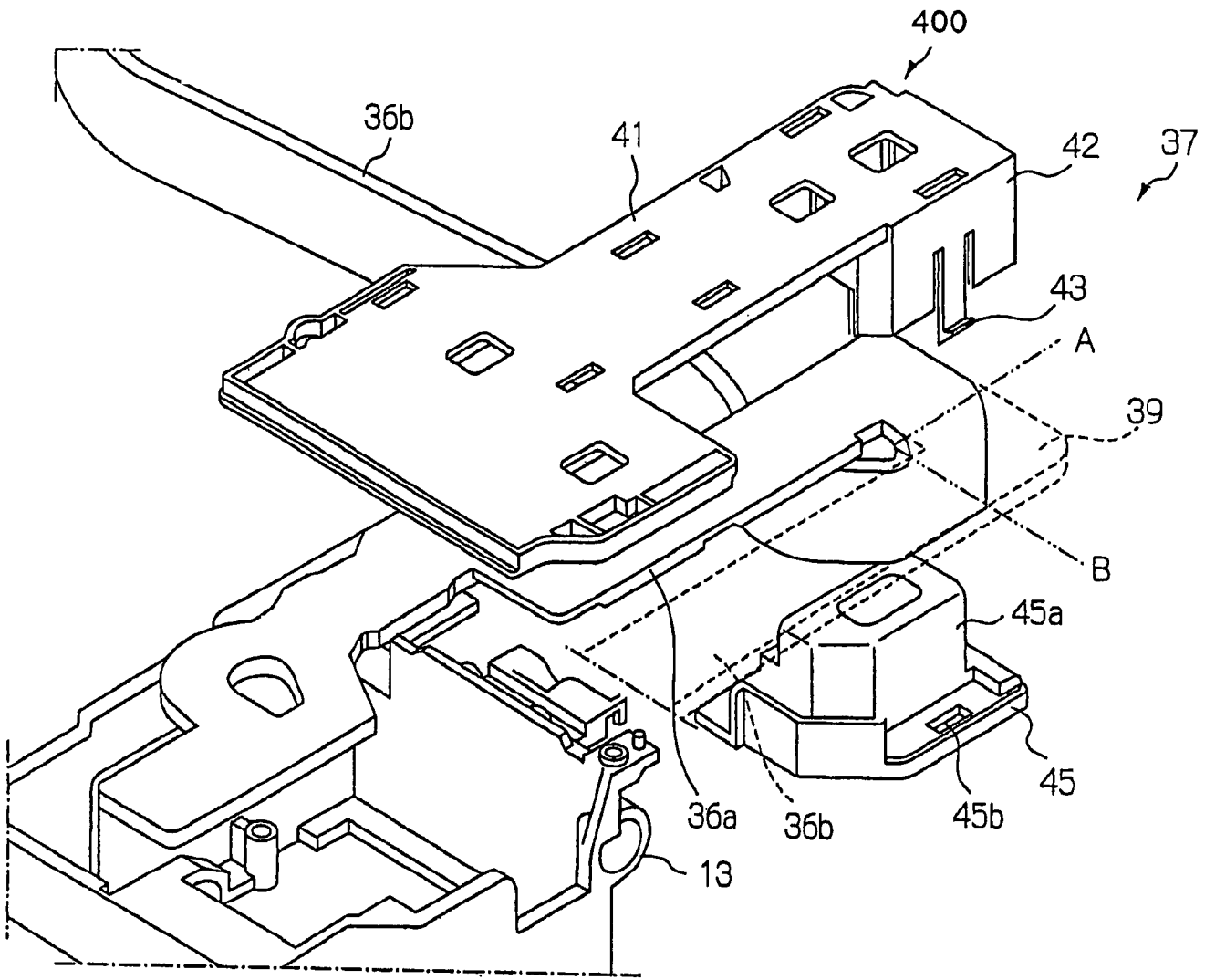
FIG. 10 is an exploded perspective view of a carriage side holding apparatus.
Figure 11A:
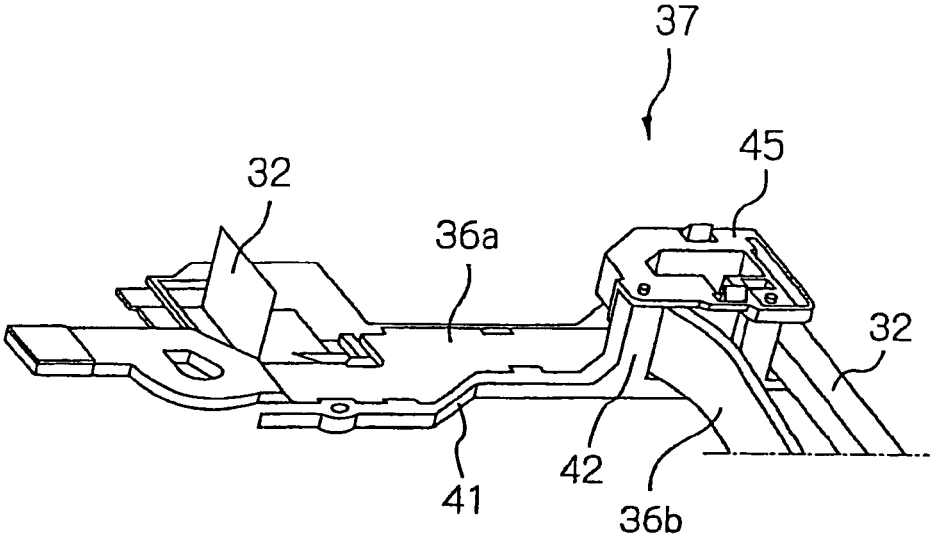
FIGS. 11A and 11B are perspective views of a holder unit.
Figure 11B:
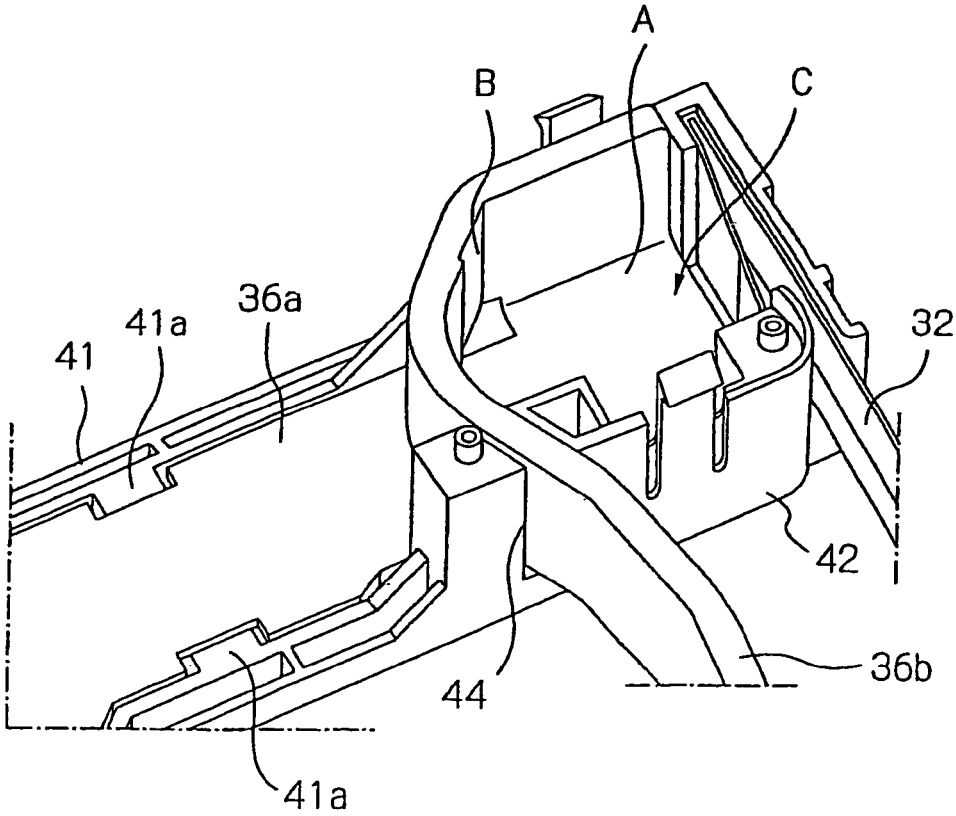

Particularly, in FIG. 10, the carriage side holding apparatus 37 includes a holding member 400 and a cover 45. The holding member 400 includes a horizontal holding unit 41 which holds the beltlike member 36 in the horizontal position, and a holder unit 42 which limits the extending direction of the path 36*b* extending to the ink cartridge side while accommodating the bend of the beltlike member when it is flexed.

To hold the beltlike member 36 by the carriage side holding apparatus 37, as shown in FIG. 10, the beltlike member 36, which extends from the carriage 13 in the horizontal position to a direction orthogonal to the main scanning direction, is bent at the center of the U-shaped first turn unit 39 shown by a reference character A, and also is bent so that the path 36*b* extending from the bend to the ink cartridge 16 is perpendicular to the path 36*a* extending to the carriage 13. In addition, the bend shown by broken lines in FIG. 10 shows a state before the first turn unit 39 is bent, and the bend shown by reference characters A and B in FIG. 11B corresponds to bending lines A and B in FIG. 10, respectively.

The holder unit 42 has the shape of a box and accommodates a bend as shown in FIG. 11B. The holder 42 further includes a groove 44 to accommodate the beltlike member 36 so that the direction of the path 36*b* extending to the ink cartridge 16 may be limited. Moreover, the cover 45 covering the opening of the holder unit 42 includes a height 45*a* to maintain the shape of the bend to be bent as shown in FIG. 10. The height 45*a* is fits into a space shown by a reference character C in FIG. 11B by attaching the cover 45 to the holder unit 42. In addition, a hole 45*b* is provided in the cover 45 and easily attachable by a latching pawl 43 formed in the holder unit 42 fitting into the hole 45*b* by snap fitting.

Moreover, in the vicinity of the first turn unit 39 of the beltlike member 36, a plurality of pawl units 36*d* are integrally formed in the beltlike member 36 across the beltlike member 36 as shown in FIG. 9. The path 36*a* extending from the first turn unit 39 to the carriage 13 is maintained to be horizontal position with such an easy construction at a low cost by the pawl units 36*d* fitting into engagement holes 41*a*, which are provided so as to correspond to the position of pawl units 36*d* of the horizontal holding unit 41 as shown in FIG. 11B.

Here, as shown in FIGS. 11A and 11B, a flexible flat cable (henceforth "FFC") 32 which interconnects the recording head 14 and the control section (not shown) of the printer 1 can be sandwiched between the horizontal holding unit 41 and the beltlike member 36. By this, it is not necessary to provide a holding component for the FFC 32 additionally, and the FFC 32 can be guided at a low cost, and a required space can be reduced.

By this, the carriage side holding apparatus 37 makes the beltlike member 36 extend from the carriage 13 in the horizontal position, bends the U-shaped first turn unit 39 so that it is bent at the center, and maintains shape of the bend so that the path 36*b* extending from the bent to the ink cartridge 16 is perpendicular to the path 36*a* extending to the carriage 13, so that the position of the beltlike member 36 is easily changed by bending the U-shaped construction because it includes the holder unit 42 as a "position change unit" which changes the position of the beltlike member 36 to the vertical position from the horizontal position. Therefore, the guidance and the holding construction of the beltlike member 36 extends from the carriage 13 can be simplified. In addition, since the position can be changed by bending the U-shaped construction, it is not necessary to detour the beltlike member 36 for the position change, thereby the position change of the beltlike member 36 can be performed in a confined space.

Next, the body side holding apparatus 38 which holds the beltlike member 36 at the body side of the printer 1 will be explained in detail with reference to FIGS. 12 and 13. Here, FIGS. 12 and 13 are perspective views of the body side holding apparatus 38.

Figure 12A:
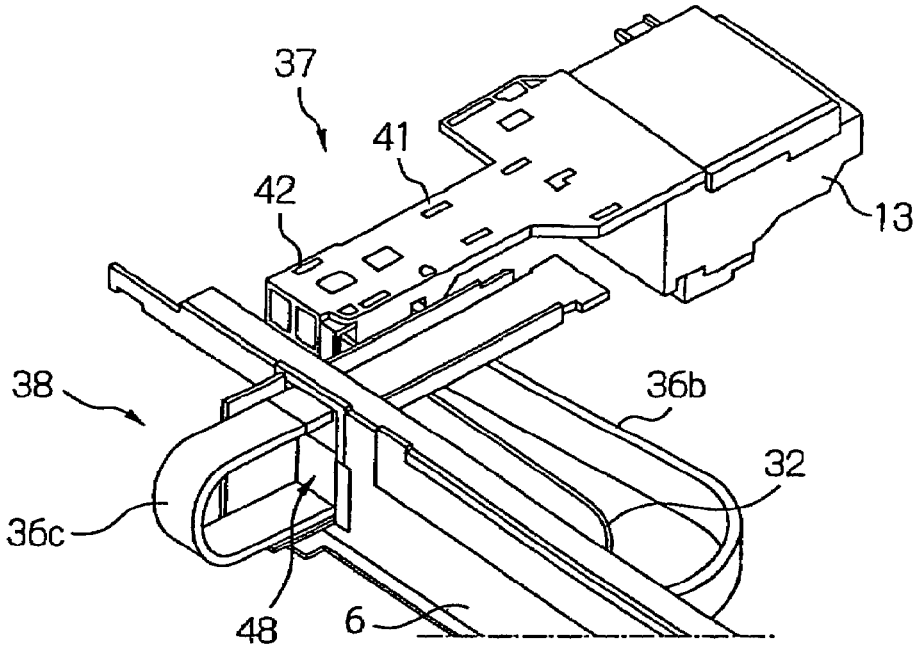
FIGS. 12A and 12B are perspective views of the body side holding apparatus.

As shown in FIG. 12A, the body side holding apparatus 38 holds the beltlike member 36 in the rear frame 6 which composes the body of the apparatus, and changes the direction of the beltlike member 36 extending from the carriage side holding apparatus 37 in the vertical position (a path shown by a reference numeral 36*b*) into the horizontal position (a path shown by a reference numeral 36*c*) to follow the slide movement of the unit 15 sliding along a direction perpendicular to the main scanning direction.

Specifically, the body side holding apparatus 38 includes a holding member 47 attached to the rear frame 6. The holding member 47 includes: a vertical holding unit 47*a* which holds the beltlike member 36 in the vertical position and a bend when the beltlike member 36 is bent; and a box-shaped accommodation unit 48 which accommodate the bend and changes the extending direction of the paths extending to the ink cartridge when the beltlike member 36 is bent.

Figure 13:
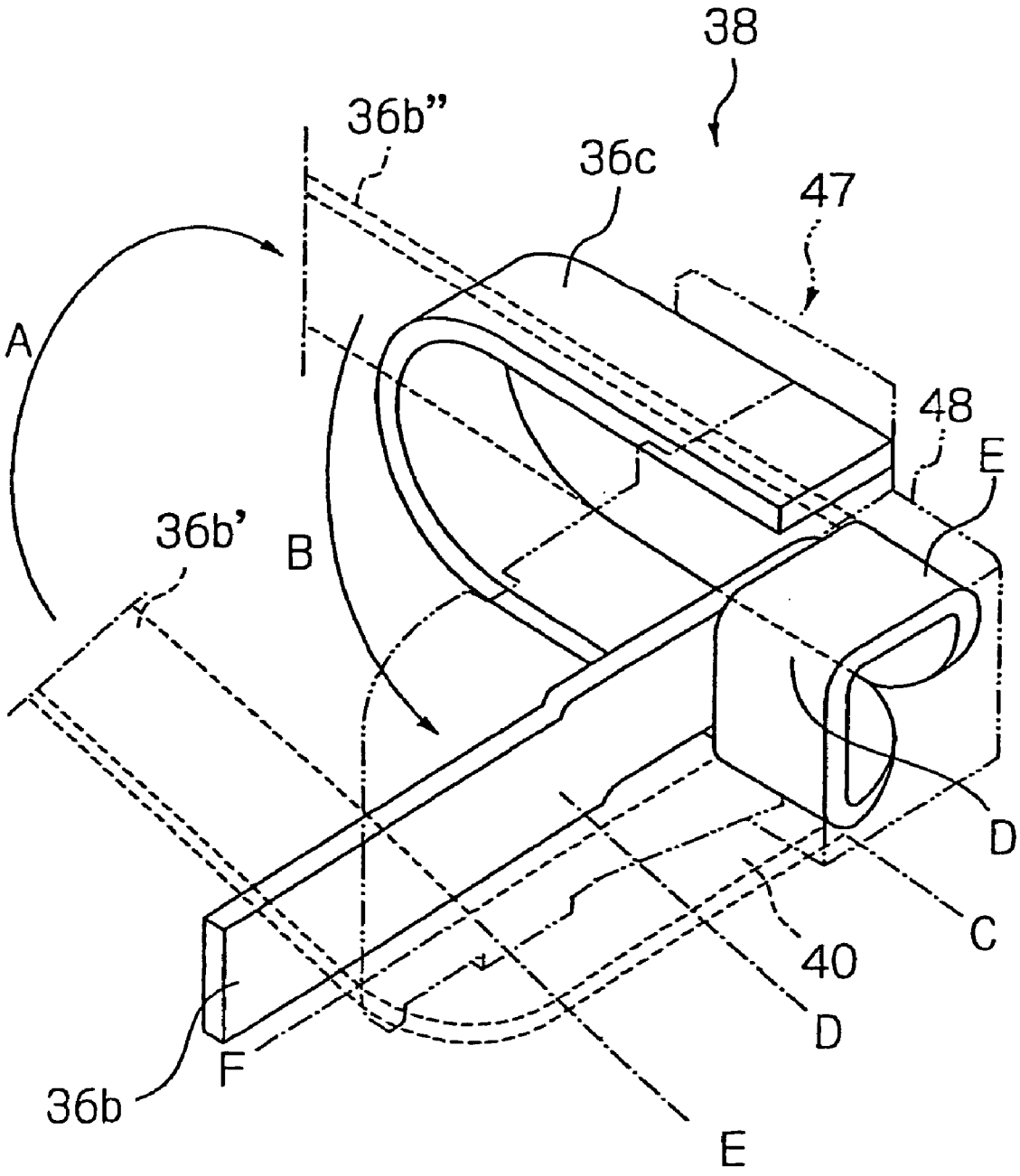
FIG. 13 is a perspective view of the body side holding apparatus.

In order to hold the beltlike member 36 by the body side holding apparatus 38 as shown in FIG. 13, the second turn unit 40 is bent over lines shown with reference characters C, D, and E. That is, it is made to be bent in the direction shown by an arrow head A, while maintaining the path 36*c* which extends to the ink cartridge 16 and the path (shown by a reference numeral 36*b*') which extends to the carriage 13 being parallel with each other. In this state, the path extending to the carriage 13 is shown by a broken-line bearing a reference numeral 36*b*". In this state, since the beltlike member 36 has elasticity, it is not completely bent over the lines C, D, and E, but it curves gradually.

In this state, it is bent so that the bend is accommodated in the accommodation unit 48 and the path 36*b*" extending to the carriage 13 is bent so that it curves over a line bearing a reference character F. That is, the state when the path 36*b*" is bent to the direction shown by a reference character B is described by continuous lines in FIG. 13. That is, the path 36*b* extending to the carriage 13 is accommodated into the accommodation unit 48 in the vertical position, the position is changed in the accommodation unit 48, and the path 36*c* extending to the ink cartridge 16 becomes horizontal position. In addition, the broken lines shown in FIG. 13 shows the state before bending the second turn unit 40, and the bends shown with reference characters C and D correspond to the bending lines C and D, respectively.

Figure 12B:
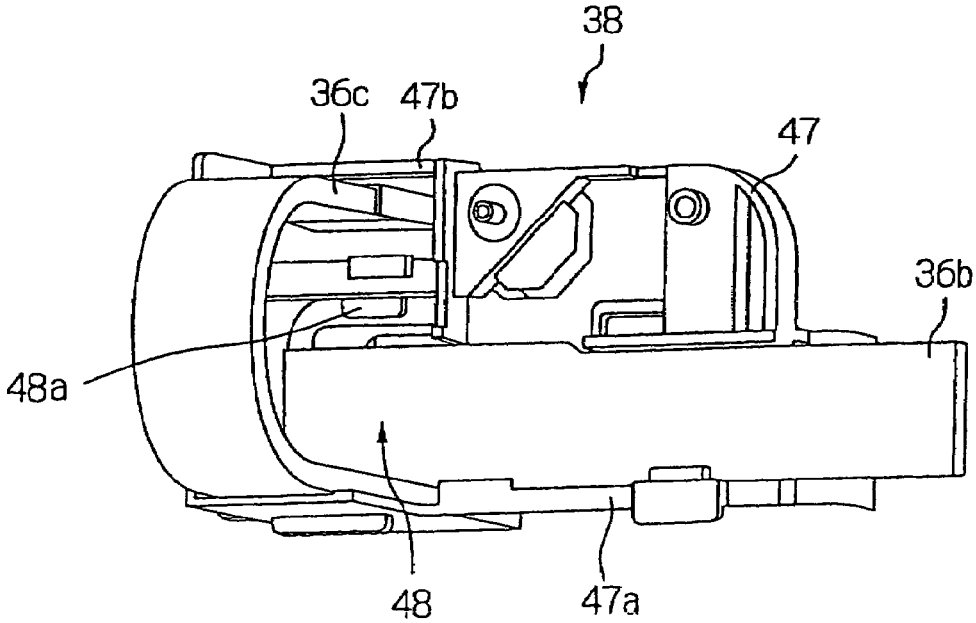

Here, inside the accommodation unit 48, since the bend tends to open due to the self-reset characteristic of the beltlike member 36, the bend is pressed to the inside surface of the accommodation unit 48, and the bend is held in the accommodation unit 48 by the characteristic. Therefore, so many components are not needed to hold the beltlike member 36 and the beltlike member 36 can be held at a low cost by a small number of components. Moreover, since the position of the beltlike member 36 can also be changed from the vertical position to the horizontal position in the accommodation unit 48, a large space is not needed to guide the beltlike member 36 that contributes to the reduction of the space. In addition, as shown in FIG. 12B, pawl unit 48*a* is formed in the accommodation unit 48. Therefore, by locking the bend of the beltlike member 36 by the pawl unit 48*a* which assists the holding force by the self-reset characteristic of the beltlike member 36, the bend can be held more securely in the accommodation unit 48.

Figure 14:
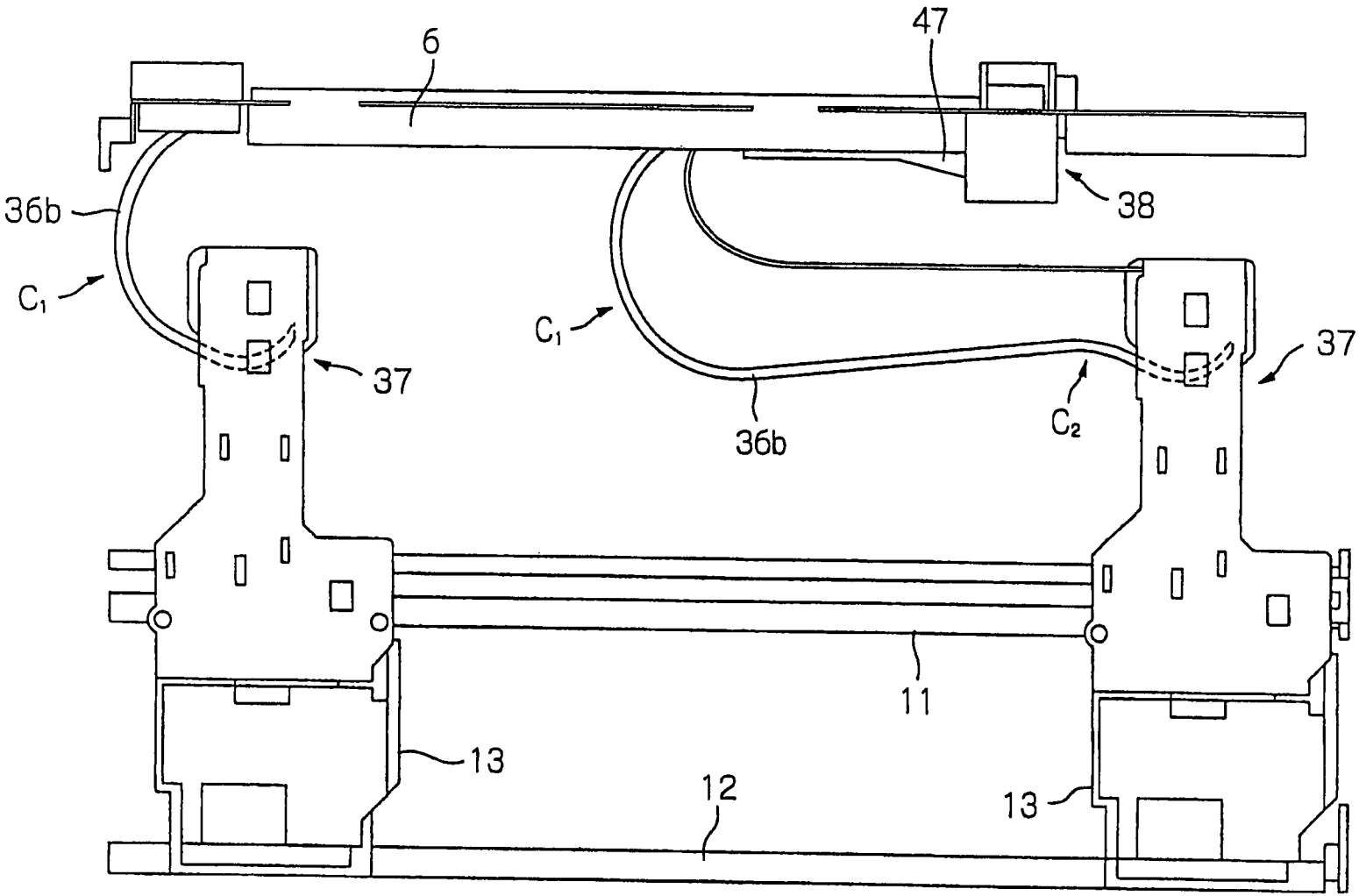
FIG. 14 is a top view of a carriage main scanning area.
Figure 15A:
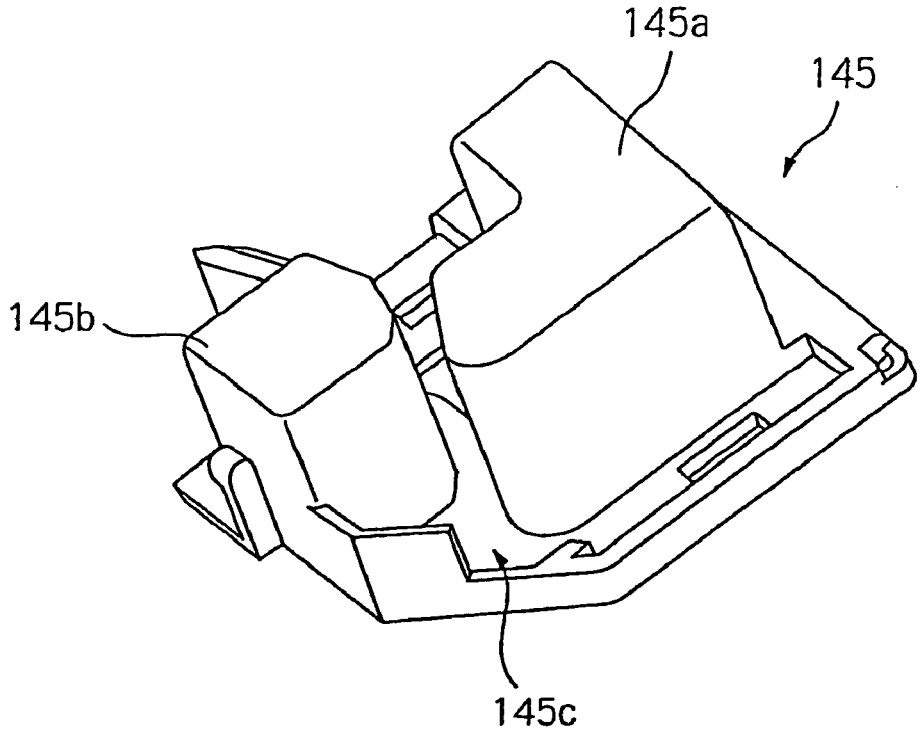
FIGS. 15A and 15B are perspective views of a cover according to another embodiment.
Figure 15B:
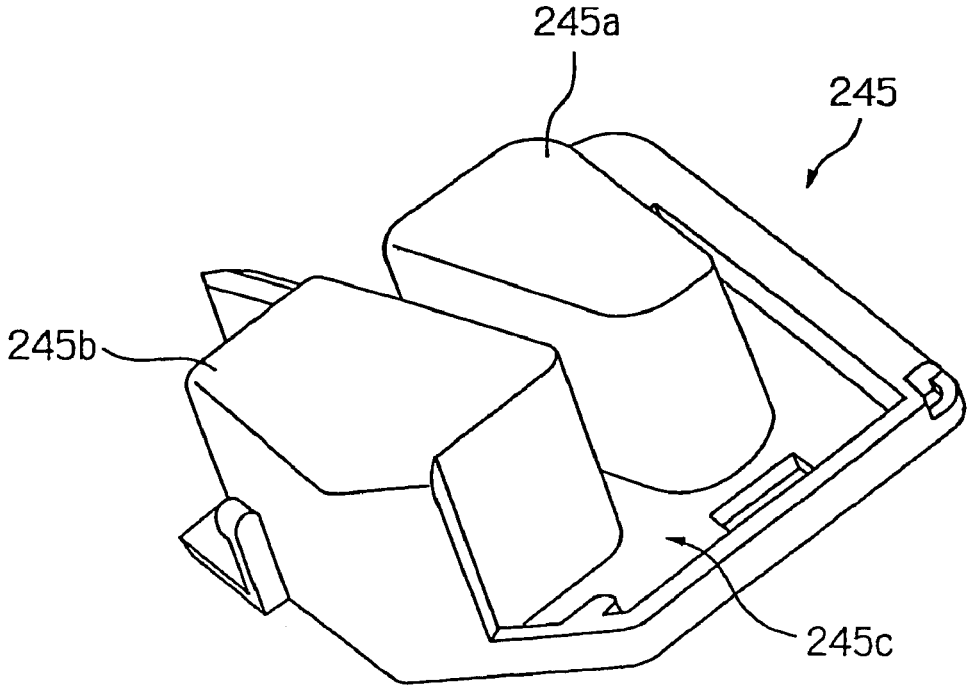
Figure 16A:
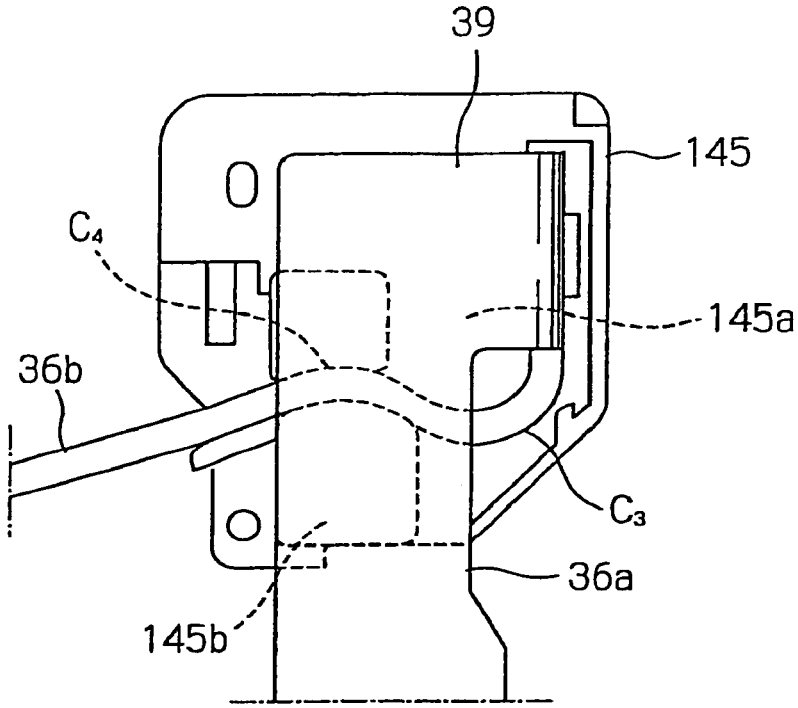
FIG. 16A is a top view of a position change unit according to another embodiment.
Figure 16B:
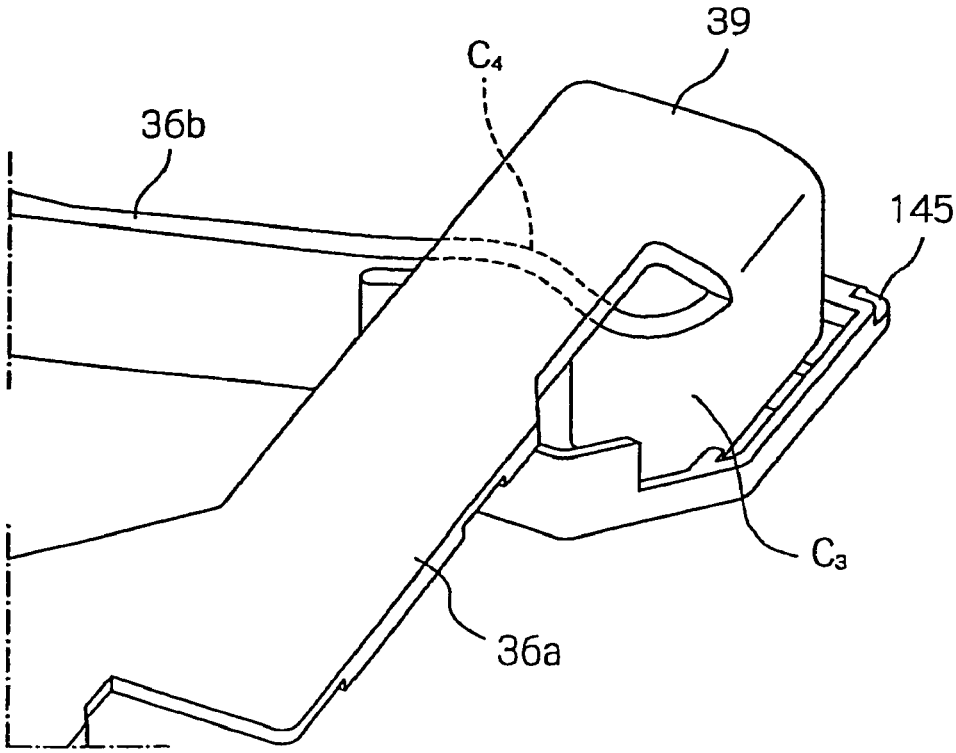
FIG. 16B is a perspective view of the position change unit.
Figure 17A:
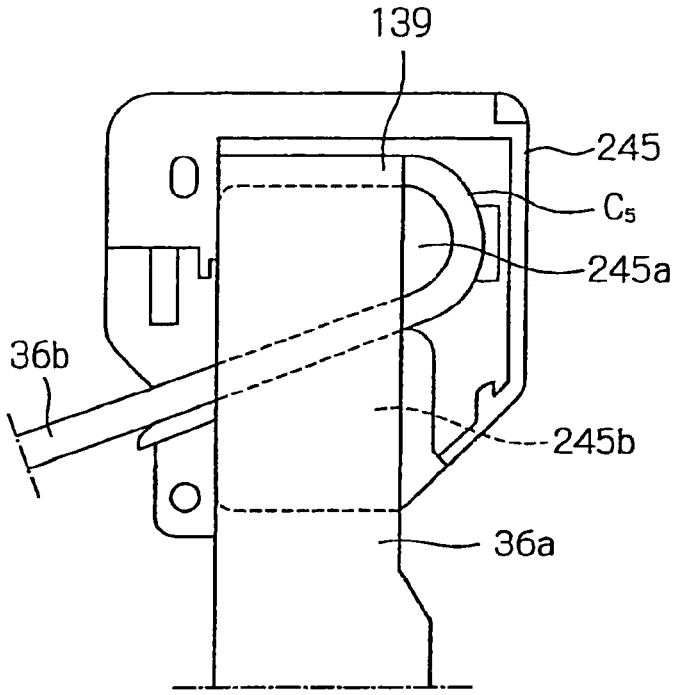
FIG. 17A is a top view of a position change unit according to yet another embodiment.
Figure 17B:
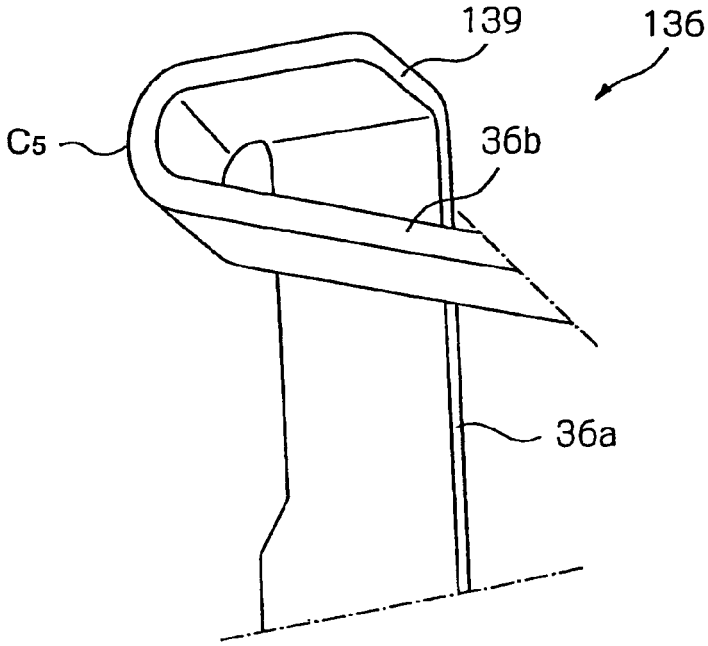
FIG. 17B is a perspective view of the position change unit.
Figure 18:
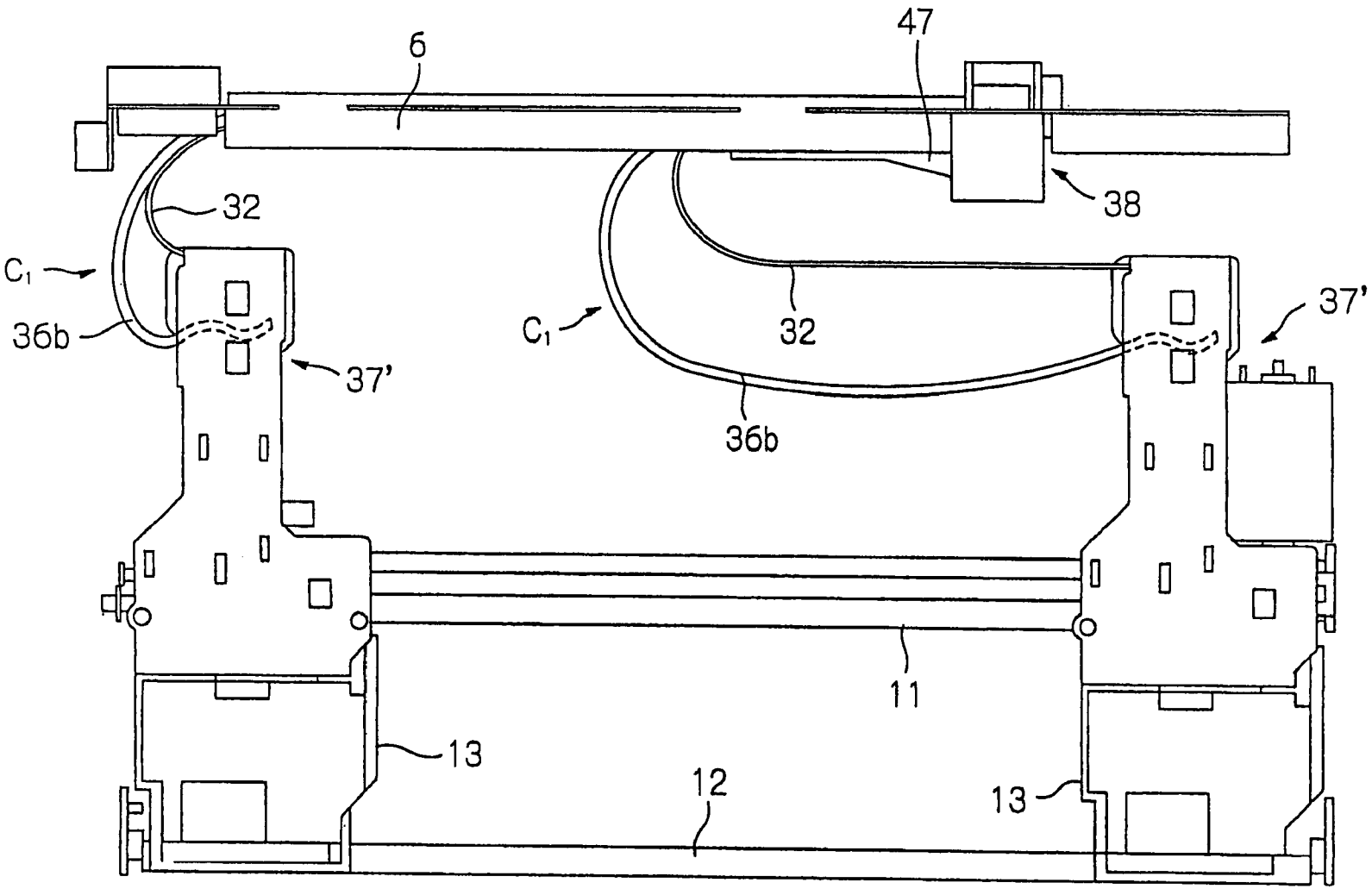
FIG. 18 is a top view of the carriage main scanning area.

Then, another embodiment of the position change unit will be described with reference to FIGS. 14–18. FIG. 14 is a top view of the main scanning area of the carriage 13 when the above-described cover 45 and the holder unit 42 are applied. FIGS. 15A and 15B are perspective views of a cover 145 and a cover 245, each of which is another embodiment of the above-mentioned cover 45. FIG. 16A is a top view of the position change unit according to another embodiment where the cover 145 is applied, and FIG. 16B is a perspective view of the position change unit. FIG. 17A is a top view of the position change unit according to yet another embodiment where the cover 245 is applied, and FIG. 17B is a perspective view of the position change unit. FIG. 18 is a top view of the carriage main scanning area of the carriage side holding apparatus 37" with which the cover 145 or the cover 245 is applied.

In addition, in FIGS. 14 and 18, the carriage 13, which is to be located at right end or left end of the main scanning area by movement along the main scanning direction, is illustrated on one drawing for convenience.

As shown in FIG. 14, when the above-described cover 45 and the holder unit 42 are applied, the extending direction of the path 36*b* of the beltlike member 36 extending from the holder unit 42 to the moving direction of the carriage 13 (leftward in FIG. 14) is limited so that path 36*b* and the carriage 13 are spaced apart a little (upward direction in FIG. 14). This is to prevent extreme swelling (downward swelling in FIG. 14) of the path 36*b*, and to prevent the path 36*b* contacting another component in the printer 1.

Here, with this construction, when the carriage 13 is in a home-position (right side in FIG. 14), the bend shown with a reference character $C_2$ is formed in the path 36*b*. On the other hand, if the carriage 13 moves to an opposite side of the home position (left side in FIG. 14), the bend shown with a reference numeral $C_2$ disappears. Therefore, the reciprocal movement of the carriage 13 along the main scanning direction results repeated and localized stress in the beltlike member 36. Thus, as already described with reference to FIG. 8, since the film 35 is attached onto the beltlike member 36, the repeated and localized stress may result the failure of the beltlike member 36 (exfoliation of the film 35).

The cover 145 or cover 245 shown in FIG. 15 is provided to prevent such the repeat stress.

First, the cover 145 shown in FIG. 15A limits the extending direction of the path 36*b* of the beltlike member 36 and the position of the beltlike member in the holder unit 42 by inserting the beltlike member 36 into the groove 145*c* formed between a projection 145*a* and a projection 145*b* as shown in FIG. 16. In addition, in the present embodiment, it is different from the cover 45 and the holder unit 42 in that the position of the beltlike member 36 is limited on the side of the cover 145 rather than on the holder unit 42.

In the present embodiment, the extreme swelling of the path 36*b* can be prevented by forming bends shown with reference characters $C_3$ and $C_4$ to make the path 36*b* extend from the side (upper side of FIG. 16A) which separates from the carriage 13 as much as possible.

Then, in this configuration, the extending direction is limited so that the path 36*b* is slightly oriented to the direction approaching the carriage 13 as shown in FIG. 16A (lower side of FIG. 16A). Then, as shown in FIG. 18, wherever the carriage 13 is along the main scanning area, irrespective of the movement of the carriage 13, the number and its curvature direction of the bend(s) formed in the path 36*b* of which the direction is changed to the vertical position can be set constant (in this case, one bend is shown with a reference character C1 in FIG. 14). Therefore, the localized and repeated stress does not occur in the path 36*b*, thereby the exfoliation of the film 35, which composes the beltlike member 36, can be prevented.

Next, like the above-mentioned cover 145, the cover 245 shown in FIG. 15B limits the extending direction of the path 36*b* of the beltlike member 36 and the position of the beltlike member in the holder unit 42 by inserting the beltlike member 36 into the groove 245*c* formed between a projection 245*a* and a projection 245*b* as shown in FIG. 17. The present embodiment is different from the previous embodiments in that the first turn unit (shown by a reference numeral 139) has a L-shaped structure (which has the U-shaped structure in the previous embodiments; the first turn unit shown with a reference numeral 39 in FIG. 9), and makes the beltlike member 36 extend by forming an bend shown with a reference character $C_5$. According to the present embodiment, since the first turn unit 139 has the L-shaped structure, the beltlike member 36 can extends with little width in the direction perpendicular to the moving direction of the carriage 13 (the vertical direction of FIG. 17), the path 36*b* can extends from the side (upper side of FIG. 17A) which separates from the carriage 13 as much as possible and the extreme swelling of the path 36*b* can be prevented.

In the configuration, like the above-described cover 145, the extending direction of the path 36*b* is limited so that the path 36*b* is slightly oriented to the direction approaching the carriage 13 as shown in FIG. 17A (lower side in FIG. 17A). Then, also in this case, as shown in FIG. 18, wherever the carriage 13 is along the main scanning area, irrespective of the movement of the carriage 13, the number and its curvature direction of the bend(s) formed in the path 36*b* of which the direction is changed to the vertical position can be set constant (in this case, one bend is shown with a reference character C1 in FIG. 18). Therefore, the localized and repeated stress does not occur in the path 36*b*, thereby the exfoliation of the film 35, which composes the beltlike member 36, can be prevented.

Figure 19:
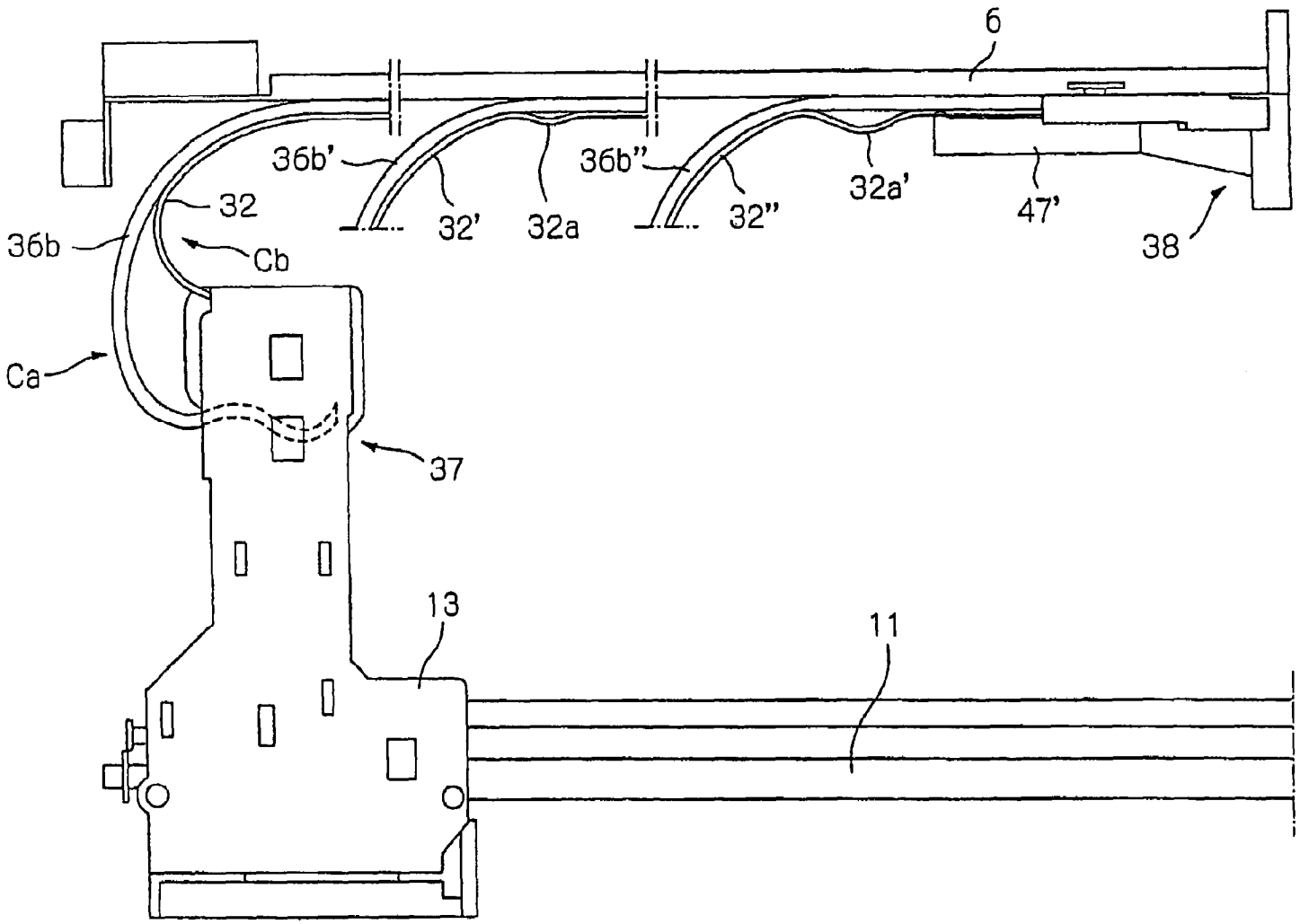
FIG. 19 is a top view of the carriage main scanning area.
Figure 20:
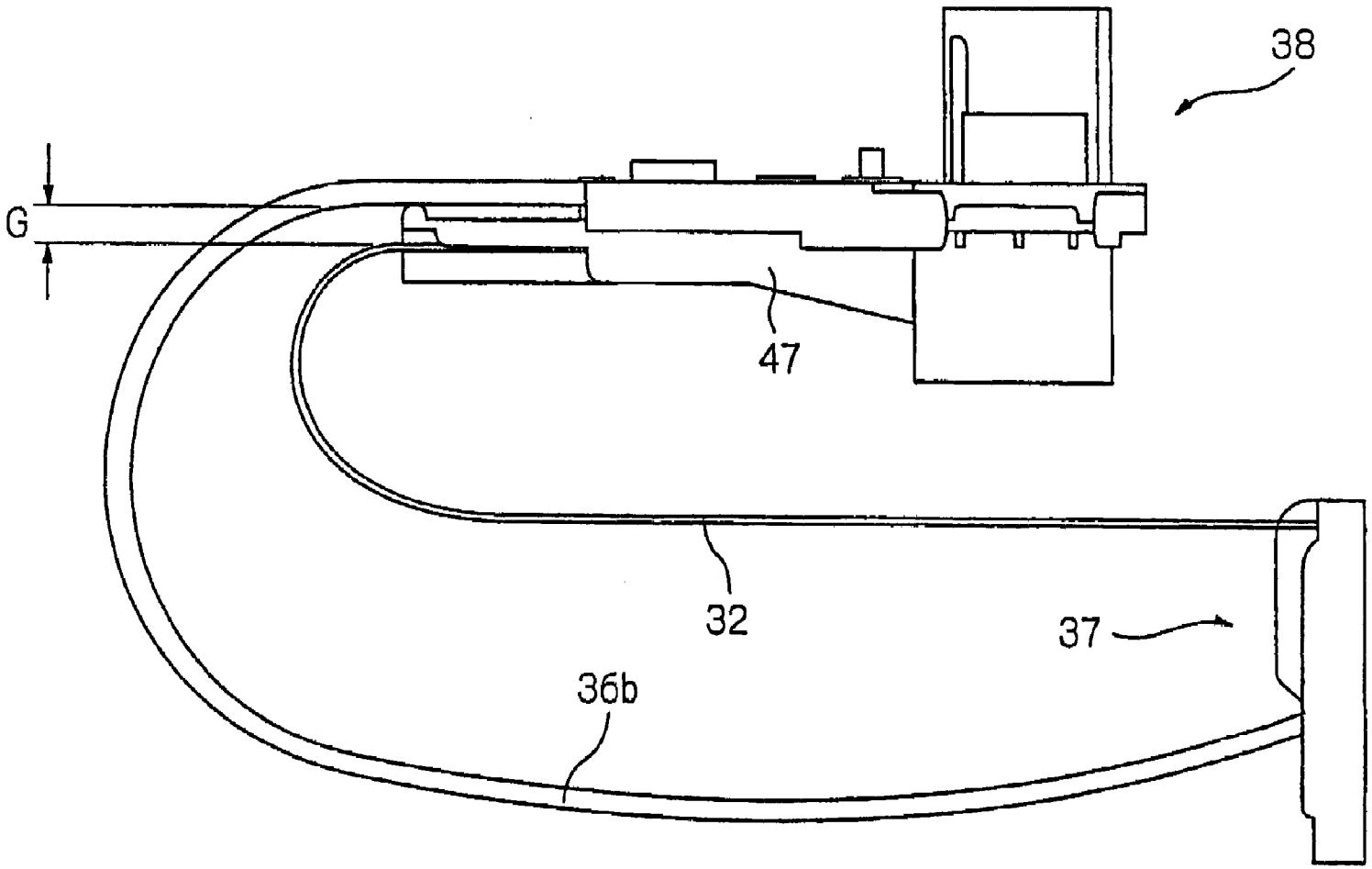
FIG. 20 is a top view of a holding member.
Figure 21:
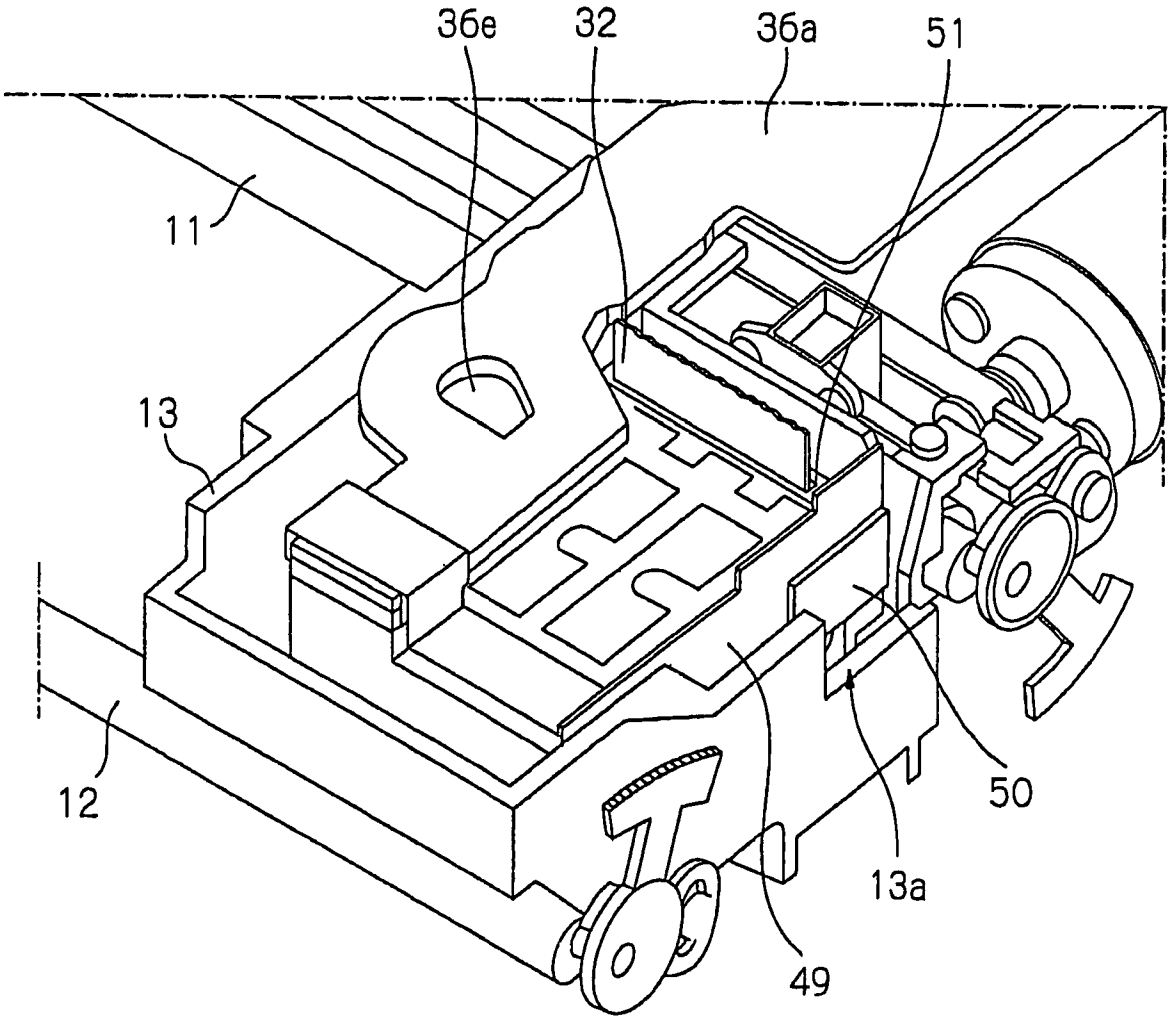
FIG. 21 is a perspective view of the carriage seen from the top.
Figure 22:
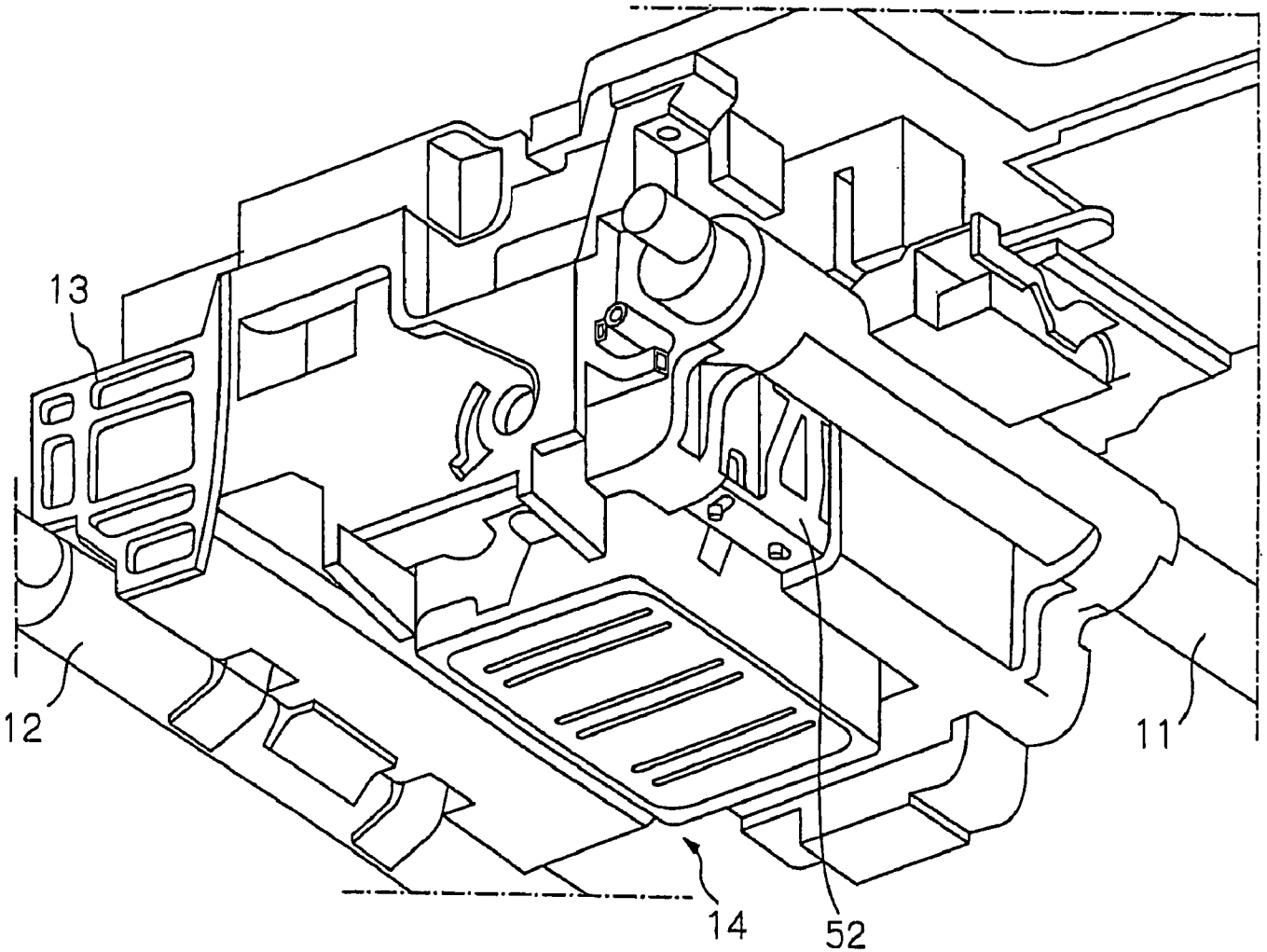
FIG. 22 is a perspective view of the carriage seen from the bottom.
Figure 23A:
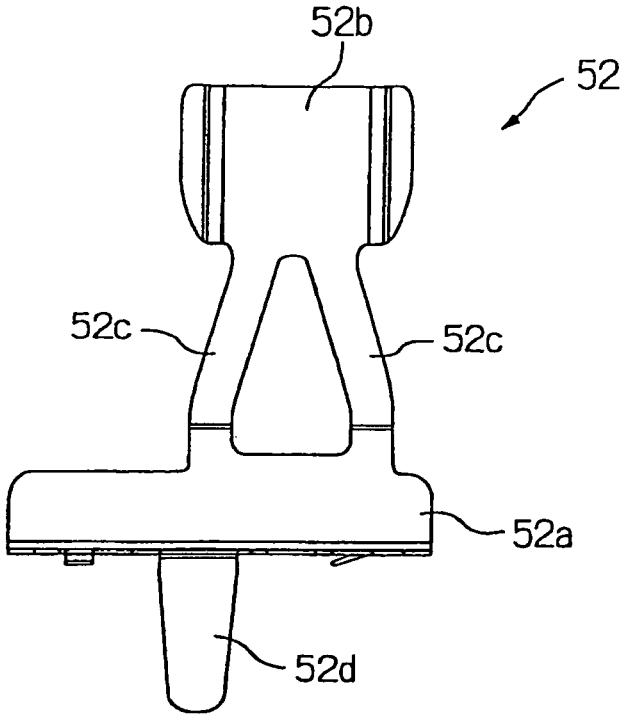
FIG. 23A is a front view of a grounding member.
Figure 23B:
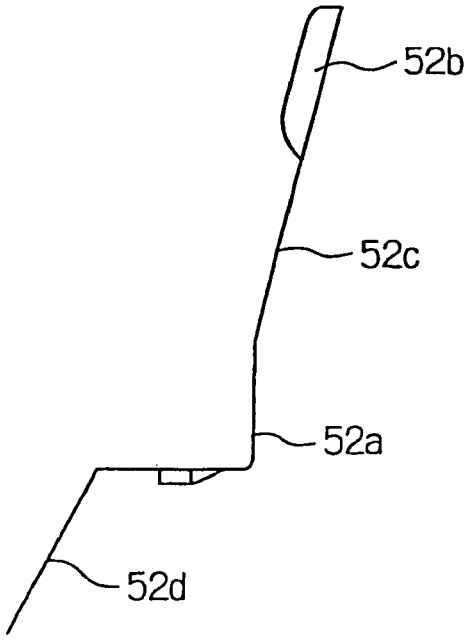
FIG. 23B is a side view of the grounding member.
Figure 26:
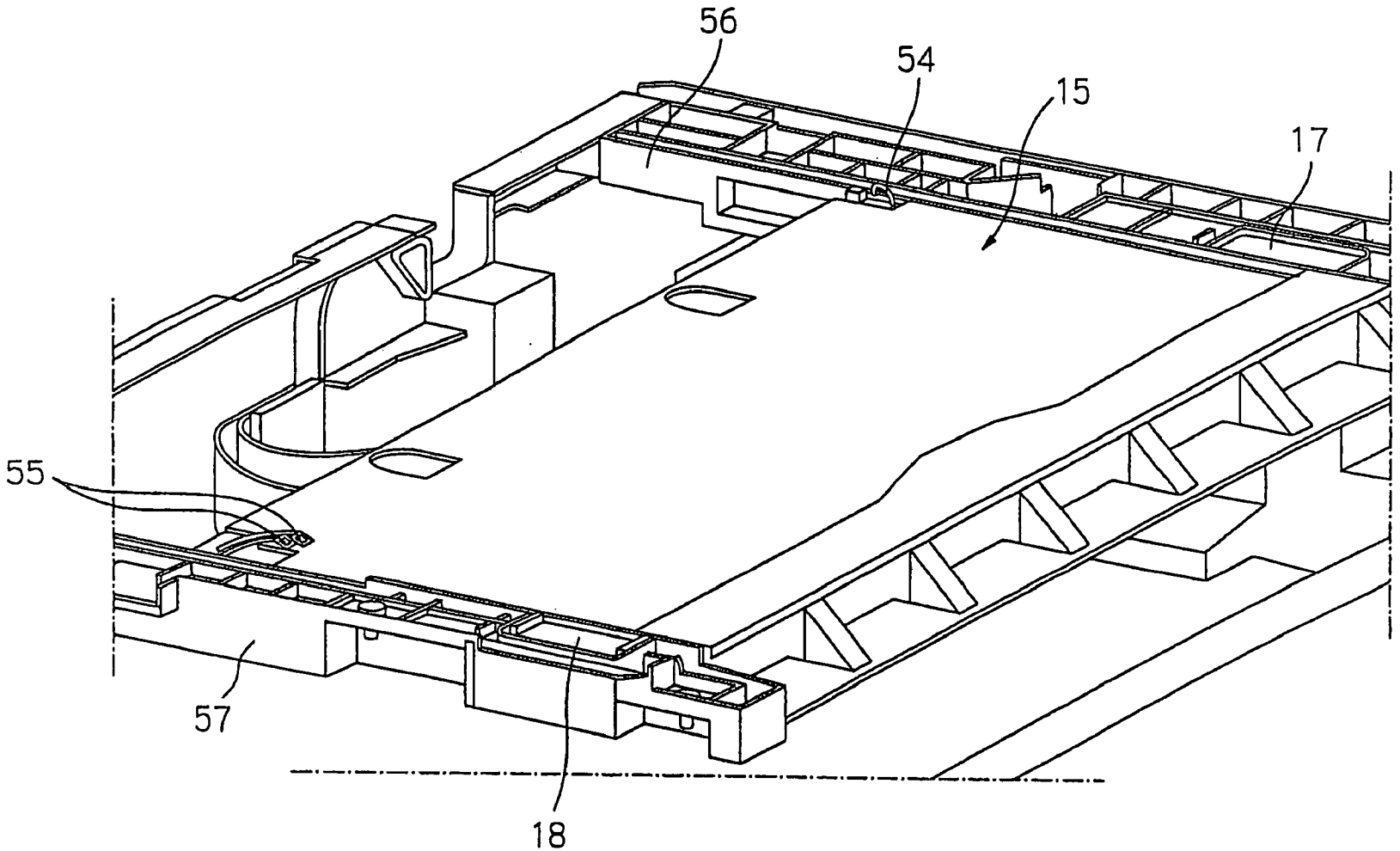
FIG. 26 is a perspective view of the ink cartridge holder.
Figure 27:
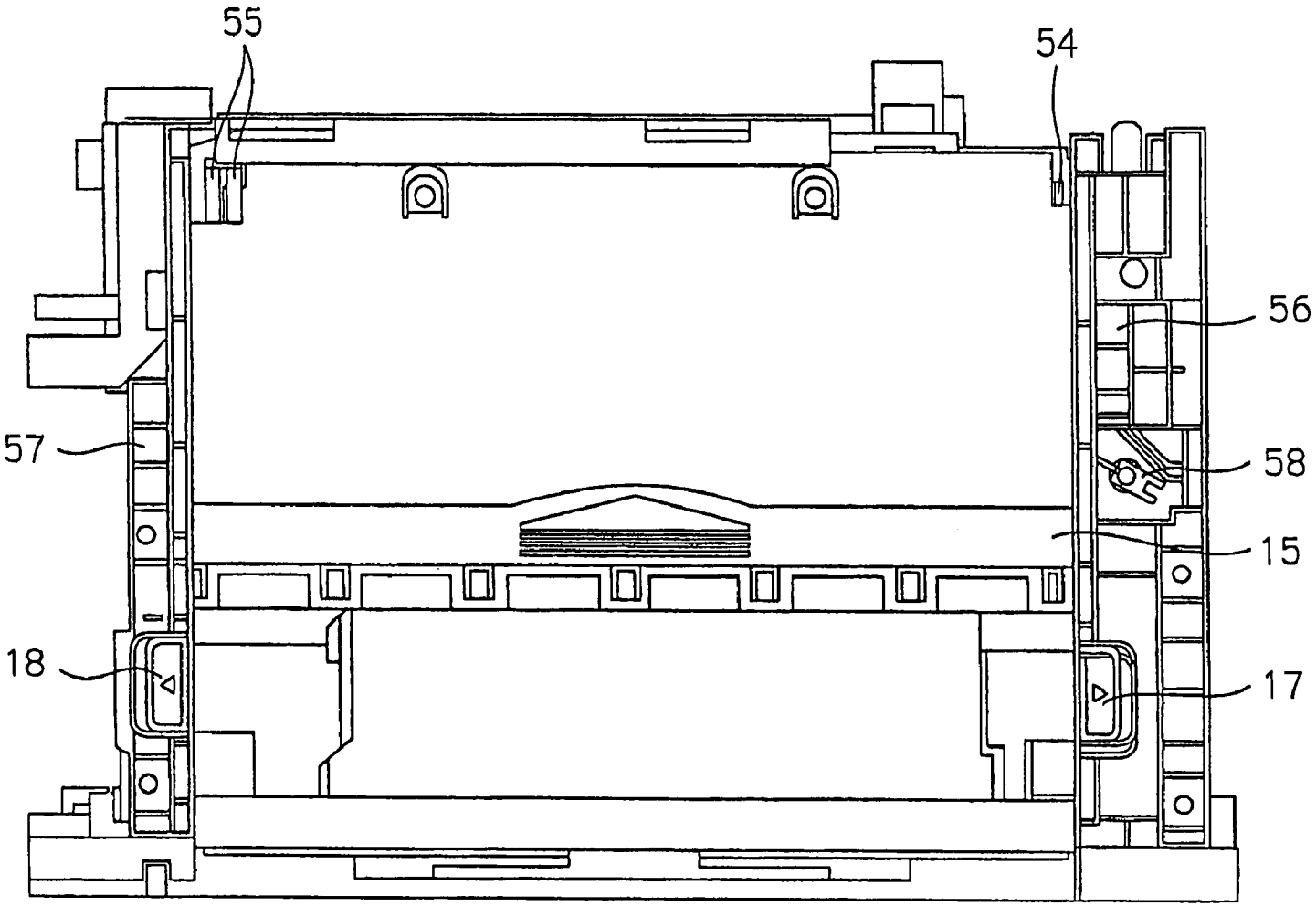
FIG. 27 is a top view of the ink cartridge holder.

Next, other characteristic configurations of the printer 1 according to the present embodiment will be described with reference to FIGS. 19–27. Here, FIG. 19 is a top view of the carriage main scanning area, and FIG. 20 is a top view of the holding member 47. Moreover, FIG. 21 is a perspective view of the carriage 13 seen from the top, FIG. 22 is a perspective view of the carriage 13 seen from the bottom, FIG. 23A is a front view of a grounding member 52, FIG. 23B is a side view of the grounding member 52, FIG. 24 are a sectional side view of a front cover 8, FIG. 25 is a perspective view illustrating inside of the front cover 8, FIG. 26 is a perspective view of the unit 15, and FIG. 27 is a top view of the unit 15.

First, the other characteristic configuration of the holding member 47 which holds the path 36*b* and the FFC 32 of the beltlike member 36 on the rear frame 6 constituting the substrate of the printer 1 will be described with reference to FIGS. 19 and 20. The path 36*b* and the FFC 32 of the beltlike member 36 are guided so that they form U-shape between the carriage side holding apparatus 37 and the body side holding apparatus 38 by extending from the carriage side holding apparatus 37 and the body side holding apparatus 38 to the same side with respect to the moving direction of the carriage 13 (left side in FIG. 14).

In such a configuration, if there is no clearance between the beltlike member 36 and the FFC 32 like the holding member shown in a reference numeral 47' in FIG. 19 when they extend from the body side holding apparatus 38, i.e., the holding member 47, the curved bend which separates from the beltlike member 36 is formed in the FFC 32 by the difference between the path of the beltlike member 36 and the path of the FFC as shown in FIG. 19 (parts shown by reference numerals 32*a* and 32*a*').

More particularly, when the carriage 13 is located at the 80th column (left side in FIG. 19), the FFC 32 is flush against the path 36*b* of the beltlike member 36. If the carriage 13 moves toward the 0th column (rightward in FIG. 19) from this state, the path 36*b* and the FFC 32 will be in the state indicated by reference numerals 36*b*' and 32' in FIG. 19. In case that the carriage 13 moves toward the 0th column from the 80th column, when the curvature of the bend Ca of the path 36*b* (grade of the variation of curvature) is not equal to the curvature of the bend Cb of the FCC 32 (grade of the variation of curvature), and when the length of the FFC 32 is slightly longer than the path 36*b* (when difference of path length occurs), local bend 32*a* is formed in the FFC 32 as shown with reference numeral 32*a*'. For example, the difference between the curvature of the bend Ca of the path 36*b* (grade of the variation of curvature) and the curvature of the bend Cb of the FCC 32 (grade of the variation of curvature) occurs when material having high rigidity (for example, above-mentioned film 35) is arranged on a surface opposite to the side facing the FFC 32 in the path 36*b*. In this case, since there is a distance between the film 35 and the FFC 32, used as the criteria of the bending, the grades of the variations of both curvatures will not be in agreement.

Then, when the carriage 13 further moves toward the 0th column, the local bend formed in the FFC 32 will become still more remarkable as shown by a reference numeral 32*a*'. Then, if the carriage 13 further moves to the 0th column, although the locally-formed bend 32*a*' soon will be absorbed by the bend Cb and it will disappear, the jarring sound (snap) comes out in response to the curvature state change of the FFC 32 (when the bend 32*a*' becomes straight). Since the carriage 13 reciprocates quite frequently in the main scanning direction during the recording operation, the jarring sound comes out periodically during the recording which bothers the user.

In order to solve such a problem, the holding member 47 is made to have a clearance G in the direction perpendicular to the moving direction of the carriage 13 (vertical direction in FIG. 20) between the beltlike member 36 and the FFC 32 as shown in FIG. 20 when the beltlike member 36 and the FFC 32 extend. Thus, by estranging the beltlike member 36 from the FFC 32, the path difference between the beltlike member 36 and the FFC 32 caused by the movement of the carriage 13 is absorbable. Therefore, the formation of the local bend and consequently the generation of the jarring sound can be prevented.

Next, the characteristic configuration of the carriage 13 will be described with reference to FIGS. 21–23.

As shown in FIG. 21, a notch (window) 13*a* is formed on the right sidewall of the carriage 13. Although this is a notch for viewing the display label 50 indicating information about a carriage 13 from outside, the ink mist may enter into the carriage 13 through the notch due to the movement of the carriage 13. Since there is provided a connector 51, which is an electric contact of the FFC 32, there is a possibility of causing an imperfect contact in the carriage 13 due to the ink mist introduction. To prevent such a problem, a plate 49 is provided as preventing means for preventing the introduction of the ink mist from the notch 13*a*. Therefore the introduction of the ink mist into the carriage 13 can be prevented with the plate 49.

Next, when the carriage 13 is assembled, after the recording head 14 provided in the carriage 13 and the beltlike member 36 are assembled in advance, the assembly is mounted with the body of the carriage 13. Here, since the beltlike member 36 is horizontal position in the carriage 13, it occupies a large space in the carriage 13 that makes the assembly of the components which composes upper parts of the carriage 13 (not shown in FIG. 21) difficult. Therefore, as shown in FIG. 21, a hole 36*e*, through which a screw passes, is formed in the beltlike member 36 to facilitate the assembly of the carriage 13.

Next, as shown in FIG. 22, the grounding member 52 which connects the recording head 14 and the main carriage guide shaft 11 to ground the recording head 14 is provided in the bottom of the carriage 13. The grounding member 52 includes: a basement 52*a* fixed to the bottom of a carriage 13 as shown in FIG. 23; support units 52C rising from the basement 52*a*; a contact unit 52*b* in sliding contact with the main carriage guide shaft 11; and a tongue 52*d* extending from the basement to the recording head 14. Here, when the contact unit 52*b* is in contact with the main carriage guide shaft 11 only on one side, (i.e., when they are in contact with a point rather than a surface), imperfect contact (imperfect grounding) will occur and unpleasant scratch noise may come out. Therefore, the distance between two support units 52*c* rising toward the contact unit 52*b* are sufficiently spaced apart in the movement direction (horizontal direction of FIG. 23A) with respect to the width of the contact unit 52*b*, so that the contact unit 52*b* is supported stably, thereby the one side contact between the contact unit 52*b* and the main carriage guide shaft 11 (i.e., when they are in contact with a point rather than a surface) can be avoided, thereby the imperfect contact and the noise can be also avoided.

Next, the characteristic configuration of the ink cartridge 16 and the unit 15 will be described with reference to FIGS. 24–27.

Figure 24A:
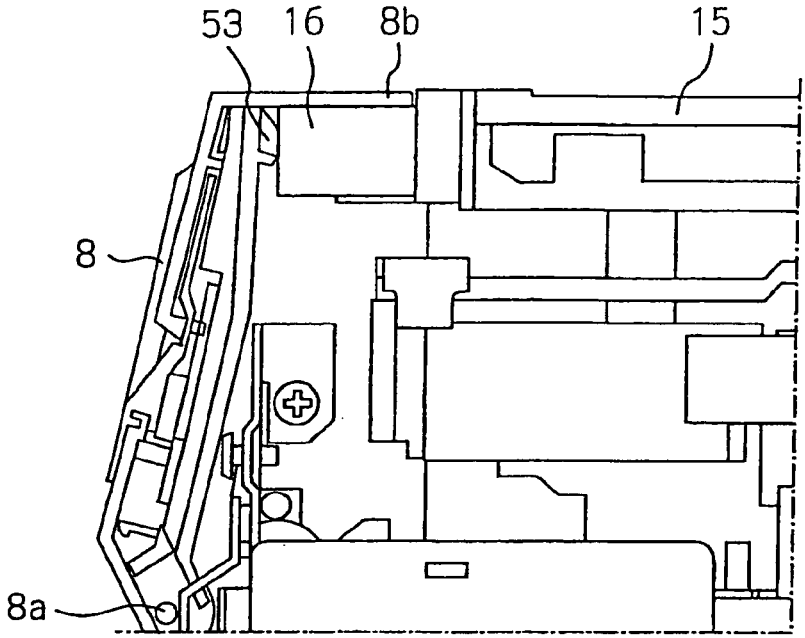
FIGS. 24A and 24B are sectional side views of a front cover.
Figure 24B:
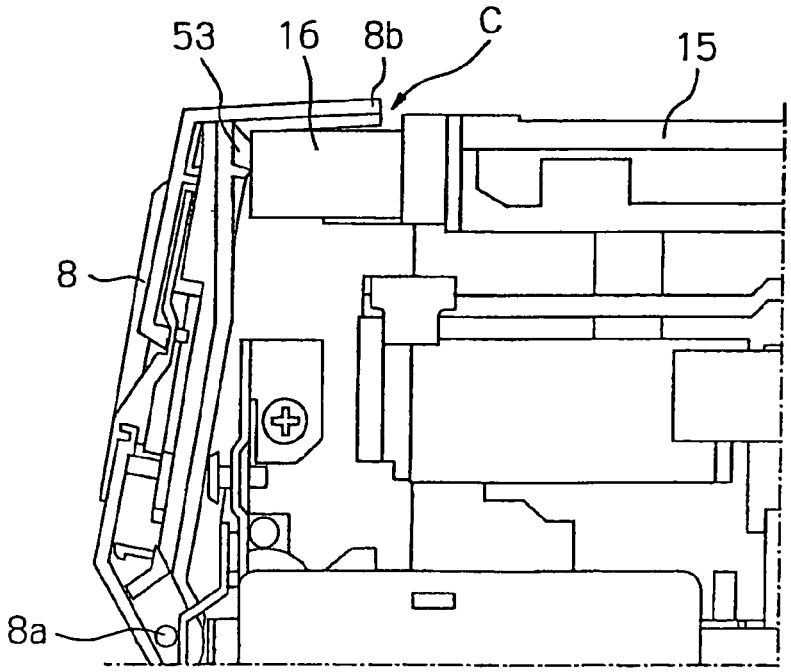
Figure 25:
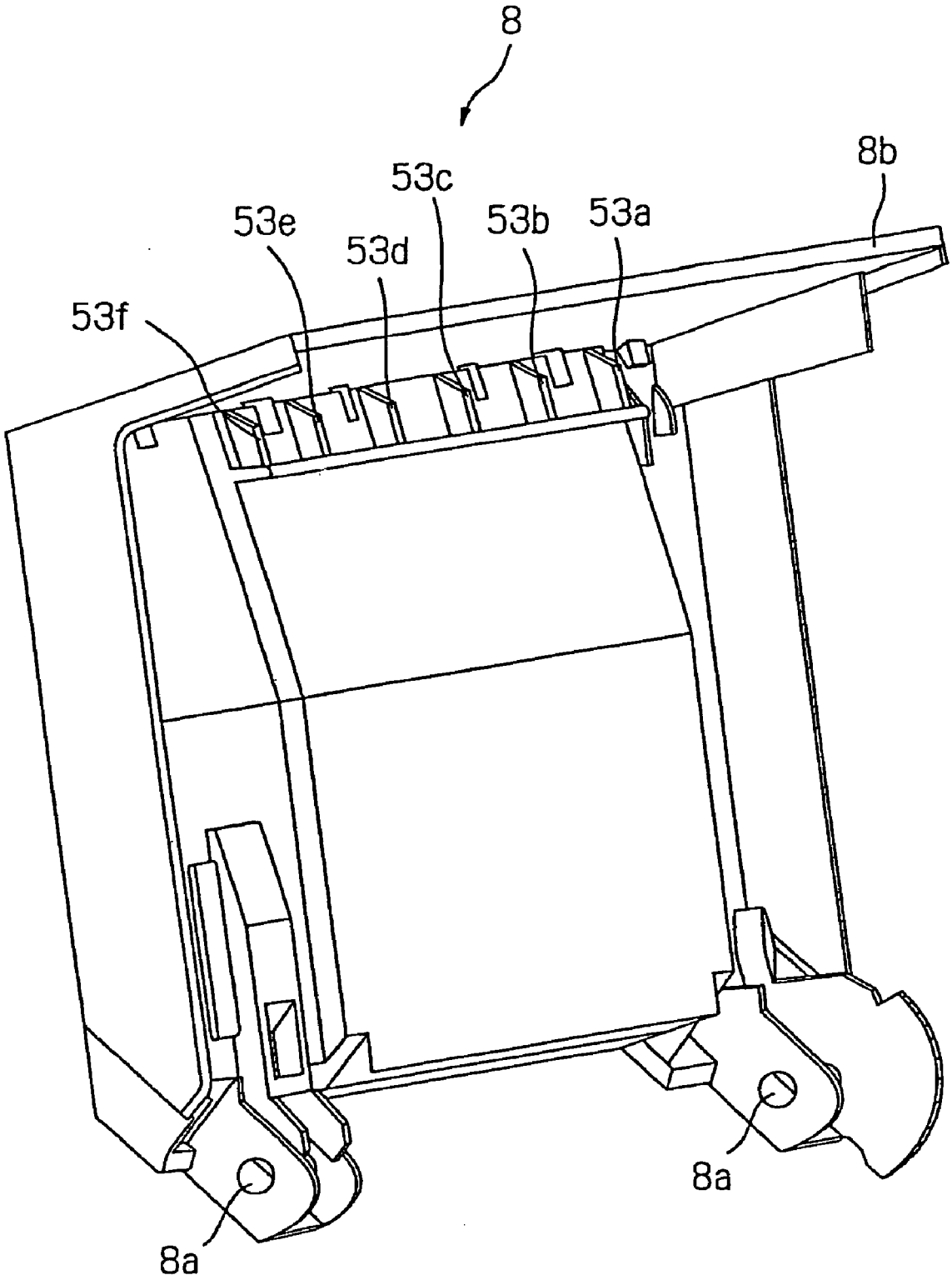
FIG. 25 is a perspective view illustrating inside of the front cover.

First, as shown in FIGS. 24 and 25, ribs 53*a*–53*f* (shown with a reference numeral 57 in FIG. 27) which project toward the ink cartridges 16*a*–16*f* are formed in the positions corresponding to ink cartridges 16*a*–16*f* respectively in the front cover 8. The ribs 53*a*–53*f* does not interfere with the ink cartridge 16 when the ink cartridge 16 is correctly mounted as shown in FIG. 24A, but when the ink cartridge 16 is not mounted correctly and protrudes forwardly (leftward in FIG. 24) a predetermined distance, it interferes with the ink cartridge 16.

Although a magnet is provided in the front cover 8 to keep the apparatus closed (the state shown in FIG. 1), when the ink cartridge protrudes forwardly a predetermined distance as stated above, the front cover 8 is pushed back by the ink cartridge 16 due to the interference between the ribs 53*a*–53*f* and the ink cartridges 16*a*–16*f*. As a result, the front cover 8 cannot be closed completely and is kept fully or half opened (the state where spacing shown with a reference character C is formed between the upper end of the front cover 8 and the unit 15).

On the other hand, a sensor (not shown), which detects whether the door of the front cover 8 is open or closed, is provided in the front cover 8. When the ink cartridge 16 is not correctly mounted and the door is fully or half open, the sensor can detect the state.

Therefore, the control section of the printer 1 can detect possibility that there is a problem in the installation of the ink cartridge 16 by the opening/closing status of the front cover 8, and can perform appropriate control according to the state. For example, when the open state of the front cover 8 is detected, the write control to an IC chip storing information about ink, such as amount of ink is terminated so that the information stored on the IC chip can be maintained to be a correct state. Moreover, it can prohibit the recording operation (ink injection operation) when the ink cartridge 16 is not mounted correctly. That is, unloaded discharge of the ink can be avoided and a desired recording result can be obtained.

Next, as shown in FIGS. 26 and 27, grounding members 54 and 55 are provided in the both ends of the rearward of the top surface of the unit 15 (upper part in FIG. 27). The grounding members 54 and 55 grounds electric circuits in the unit 15 by contacting a contact unit (not shown) which is provided at the top of the internal surface of the housing 3. Moreover, the grounding members 54 and 55 are made of resilient material and protrude toward the top of the internal surface of the housing 3. Therefore, saccadic movement of the unit 15 is avoided when it is mounted and it is stabilized in the horizontal direction. That is, since it serves as the grounding means and also as the stabilization means (actuation means) of the unit 15, simple and inexpensive apparatus can be provided.

Next, in guide members 56 and 57 for guiding the unit 15 as shown in FIG. 27, a sensor 58 for detecting open/close status of the unit 15 is provided in the side of the member 56. That is, the unit 15 is being able to retract from the main scanning area of the carriage 13 as shown by the change from the state shown in FIG. 5 to FIG. 6 by manipulating unit retracting knobs 56 and 57 as are described with reference to FIG. 5, which facilitates solving problems such as paper jam by enabling disengagement of the upper area of the carriage 13 in this way. However, when the carriage 13 operates in such an open state, the paper jam problem becomes much more serious, or even causing the damage to the apparatus. Accordingly, the carriage 13 can be controlled so as not to move when the sensor 58 detects that the unit 58 is in the retracted position (the position shown in FIG. 6), thereby the above-mentioned problems can be avoided.

Although the invention has been described in its preferred from with a certain degree of particularity and obviously many changes and variations are possible therein. It is therefore to be understood that the present invention may be practiced than as specifically described herein without departing from scope and spirit thereof.

What is claimed is:

1. A flexible beltlike member holding apparatus operable to hold a flexible beltlike member in a carriage of a recording apparatus, the recording apparatus comprising:

an ink jet recording head provided in the carriage reciprocating along a main scanning direction;

an ink cartridge provided independently of the carriage; and a flexible beltlike member in which an ink channel, which interconnects the ink jet recording head and the ink cartridge, is provided, wherein a turn unit is formed in the flexible beltlike member, wherein the turn unit is in U shape seen from top, and the flexible beltlike member holding apparatus comprises a position change unit operable to change position of the flexible beltlike member from a horizontal position to a vertical position by making the flexible beltlike member extend from the carriage in a substantially horizontal position, by bending the turn unit at center of the U-shape to form at least one bend and by maintaining the bend so that a side extending from the bend to the ink cartridge is perpendicular to a side extending to the carriage.

2. The flexible beltlike member holding apparatus as claimed in claim 1, wherein the position change unit comprises:

a holder unit operable to accommodate the bend of the flexible beltlike member and to limit a direction extending toward the ink cartridge; and a cover operable to cover an opening of the holder unit, wherein the cover has a convex for maintaining the bent construction of the flexible beltlike member.

3. The flexible beltlike member holding apparatus as claimed in claim 2, wherein the holder unit is attached to the cover by snap fitting.

4. The flexible beltlike member holding apparatus as claimed in claim 1, wherein a pawl unit is integrally provided in the flexible beltlike member in a direction perpendicular to a longitudinal direction of the flexible beltlike member, and the flexible beltlike member is held substantially horizontally by the pawl unit fitting into an engagement hole formed in a horizontal holding unit for holding the flexible beltlike member substantially horizontally.

5. The flexible beltlike member holding apparatus as claimed in claim 4, wherein a flexible flat cable interconnecting a control section and the ink jet recording head of the recording apparatus is sandwiched between the flexible beltlike member and the horizontal holding unit.

6. The flexible beltlike member holding apparatus as claimed in claim 1, wherein a number of the at least one bend and a curvature direction of the at least one bend are consistent irrespective of movement of the carriage, wherein the at least one bend is formed in a space where the direction of the flexible beltlike member is changed to the vertical direction by the position change unit.

7. A recording apparatus comprising:

an ink jet recording head provided in a carriage reciprocating along a main scanning direction;

an ink cartridge provided independently of the carriage;

a flexible beltlike member in which an ink channel, which interconnects the ink jet recording head and the ink cartridge, is provided; and a flexible beltlike member holding apparatus operable to hold the flexible beltlike member in a carriage of a recording apparatus, wherein a turn unit is formed in the flexible beltlike member, wherein the turn unit is in U shape seen from top, and the flexible beltlike member holding apparatus comprises a position change unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the ink cartridge is perpendicular to a side extending to the carriage.

8. The recording apparatus as claimed in claim 7, further comprising a body side holding apparatus operable to hold the flexible beltlike member and a flexible flat cable extending from the position change unit at a body side of the recording apparatus, wherein the direction of each of the flexible beltlike member and the flexible flat cable is changed to a vertical position by the position change unit, and the flexible beltlike member and the flexible flat cable are guided so that each of them is substantially in a U-shape, and have a clearance between the flexible beltlike member and the flexible flat cable in a direction perpendicular to a moving direction of the carriage.

9. A liquid ejecting apparatus comprising:

a liquid injection head provided in a carriage reciprocating along a main scanning direction;

a liquid cartridge provided independently of the carriage;

a flexible beltlike member in which a liquid channel for interconnecting the liquid injection head and the liquid cartridge is formed; and a flexible beltlike member holding apparatus operable to hold the flexible beltlike member in the carriage, wherein a turn unit is formed in the flexible beltlike member, wherein the turn unit is in U shape seen from top, and the flexible beltlike member holding apparatus comprises a position change unit operable to change position of the flexible beltlike member from a horizontal position to a vertical position by making the flexible beltlike member extend from the carriage in a substantially horizontal position, by bending the turn unit at center of the U-shaped construction, and by maintaining the bent construction so that a side extending from the bend to the liquid cartridge is perpendicular to a side extending to the carriage.

10. A flexible beltlike member holding apparatus operable to hold a flexible beltlike member at a body side of a recording apparatus, wherein the recording apparatus comprises:

an ink jet recording head provided in a carriage reciprocating along a main scanning direction;

an ink cartridge provided independently of the carriage; and a flexible beltlike member in which an ink channel, which interconnects the ink jet recording head and the ink cartridge, is provided, wherein a turn unit is formed in the flexible beltlike member so that an ink channel extending to the ink cartridge is substantially parallel with an ink channel extending to the carriage, wherein the turn unit is in U shape seen from top, the flexible beltlike member holding apparatus comprises an accommodation unit operable to accommodate a bend formed by bending the turn unit at center of the U-shaped construction so that the parallelity between the ink channel extending to the ink cartridge and the ink channel extending to the carriage may be maintained, and the flexible beltlike member holding apparatus holds the bend in the accommodation unit using self-reset characteristic of the bend in the accommodation unit.

11. The flexible beltlike member holding apparatus as claimed in claim 10 wherein, a pawl unit is formed in the accommodation unit, and the bend is locked by the pawl unit in the accommodation unit.

12. The flexible beltlike member holding apparatus as claimed in claim 10, wherein the ink cartridge is provided so that it may slide along a direction perpendicular to the main scanning direction, the flexible beltlike member extending to the ink cartridge from the accommodation unit extends toward a rear side of the recording apparatus on which a flat surface is maintained to be substantially horizontal, it curves and turns over, and then extends along the ink cartridge, and the flexible beltlike member extending to the carriage from the accommodation unit extends along the main scanning direction of which the flat surface is maintained to be substantially vertical.

13. A recording apparatus comprising:

an ink jet recording head provided in a carriage reciprocating along a main scanning direction;

an ink cartridge provided independently of the carriage;

a flexible beltlike member in which an ink channel, which interconnects the ink jet recording head and the ink cartridge, is provided; and a flexible beltlike member holding apparatus operable to hold a flexible beltlike member at a body side of the recording apparatus, wherein a turn unit is formed in the flexible beltlike member so that an ink channel extending to the ink cartridge is substantially parallel with an ink channel extending to the carriage, wherein the turn unit is in U shape seen from top, the flexible beltlike member holding apparatus comprises an accommodation unit operable to accommodate a bend formed by bending the turn unit at center of the U-shaped construction so that the parallelity between the ink channel extending to the ink cartridge and the ink channel extending to the carriage may be maintained, and the recording apparatus is configured to hold the bend in the accommodation unit using self reset characteristic of the bend in the accommodation unit.

14. A liquid ejecting apparatus comprising:

a liquid injection head provided in a carriage reciprocating along a main scanning direction;

a liquid cartridge provided independently of the carriage;

a flexible beltlike member in which a liquid channel for interconnecting the liquid injection head and the liquid cartridge is formed; and a flexible beltlike member holding apparatus operable to hold the flexible beltlike member at a body side of the recording apparatus, wherein a turn unit is formed in the flexible beltlike member so that a liquid channel extending to the liquid cartridge is substantially parallel with a liquid channel extending to the carriage, wherein the turn unit is in U shape seen from top, the flexible beltlike member holding apparatus comprises an accommodation unit operable to accommodate a bend formed by bending the turn unit at center of the U-shaped construction so that the parallelity between the liquid channel extending to the liquid cartridge and the a liquid channel extending to the carriage may be maintained, and the flexible beltlike member holding apparatus holds the bend in the accommodation unit using self-reset characteristic of the bend in the accommodation unit.

* * * * *